US008925463B1

(12) United States Patent
Sullivan et al.

(10) Patent No.: US 8,925,463 B1
(45) Date of Patent: Jan. 6, 2015

(54) PRESSURE RELIEF SYSTEM FOR GUN FIRED CANNON CARTRIDGES

(75) Inventors: Kevin Michael Sullivan, Kennebunk, ME (US); Marcelo Edgardo Martinez, Cordoba (AR); Nicolas Horacio Bruno, Cordoba (AR); Brian Desmarais, Kennebunk, ME (US)

(73) Assignee: KMS Consulting, LLC, Kennebunk, ME (US)

( * ) Notice: Subject to any disclaimer, the term of this patent is extended or adjusted under 35 U.S.C. 154(b) by 167 days.

(21) Appl. No.: 13/597,640

(22) Filed: Aug. 29, 2012

Related U.S. Application Data

(63) Continuation-in-part of application No. 12/875,402, filed on Sep. 3, 2010, now Pat. No. 8,573,127.

(60) Provisional application No. 61/653,600, filed on May 31, 2012, provisional application No. 61/239,464, filed on Sep. 3, 2009.

(51) Int. Cl.
*F41A 17/16* (2006.01)
*F42B 15/36* (2006.01)

(52) U.S. Cl.
USPC ..... 102/439; 102/430; 102/469; 102/481

(58) Field of Classification Search
CPC ..... F42B 33/04; F42B 39/00; F42B 39/14; F42B 39/20
USPC ..... 102/430, 439, 469, 470, 481, 202.1, 102/441
See application file for complete search history.

(56) References Cited

U.S. PATENT DOCUMENTS

| | | | | |
|---|---|---|---|---|
| 3,927,791 | A | | 12/1975 | Hershberger |
| 4,892,038 | A | * | 1/1990 | Lubbers ..... 102/439 |
| 5,044,154 | A | * | 9/1991 | English et al. ..... 60/223 |
| 5,155,295 | A | | 10/1992 | Campoli |
| 5,311,820 | A | | 5/1994 | Ellingsen |

(Continued)

FOREIGN PATENT DOCUMENTS

WO 2011071576 A1 6/2011

OTHER PUBLICATIONS

Kohnken, KH. Ceramic Gun Barrels, Advanced Materials & Processes; Sep. 2002, pp. 01-02.

(Continued)

*Primary Examiner* — Bret Hayes
*Assistant Examiner* — Derrick Morgan
(74) *Attorney, Agent, or Firm* — Karl F. Milde, Jr.; Eckert Seamans Cherin & Mellott, LLC

(57) ABSTRACT

A high velocity munition comprises a projectile, mounted on a cartridge case, that can be fired from an automatic cannon or weapon. During storage or transport an IM venting device included in the cartridge case prevents the propellant charge from firing the projectile, leaving the cartridge damaged, but intact upon premature ignition. The IM vent exhaust channel is filled with a solid fusible material that melts at a lower temperature than the ignition temperatures of the igniter (or primer) and the propellant charge of the projectile. At least one non-fusible, ruptureable member is included in the IM vent channel and positioned to provide structural integrity to the fusible material in the channel. Alternatively or in addition to the fusible material, a shape memory alloy ring surrounds the igniter (or primer) and separates from the cartridge when the cartridge reaches a temperature that causes auto-ignition.

10 Claims, 14 Drawing Sheets

(56) References Cited

U.S. PATENT DOCUMENTS

| | | | | |
|---|---|---|---|---|
| 5,398,498 | A * | 3/1995 | Mort et al. | 60/223 |
| 5,621,183 | A * | 4/1997 | Bailey | 102/202.7 |
| 5,735,114 | A * | 4/1998 | Ellingsen | 60/39.1 |
| 5,936,189 | A | 8/1999 | Lubbers | |
| 6,321,656 | B1 * | 11/2001 | Johnson | 102/377 |
| 6,679,177 | B1 * | 1/2004 | Wu et al. | 102/377 |
| 6,752,085 | B2 * | 6/2004 | Roach | 102/481 |
| 7,051,511 | B2 * | 5/2006 | Prytz | 60/223 |
| 7,107,909 | B2 | 9/2006 | Haeselich | |
| 7,472,653 | B1 * | 1/2009 | Hays et al. | 102/481 |
| 8,082,846 | B2 * | 12/2011 | Cook et al. | 102/377 |
| 8,246,255 | B2 * | 8/2012 | Raberin et al. | 384/539 |
| 8,408,136 | B1 * | 4/2013 | Lee | 102/377 |
| 8,550,004 | B1 * | 10/2013 | Woo et al. | 102/430 |
| 8,584,588 | B2 * | 11/2013 | Larousse et al. | 102/481 |
| 8,616,131 | B2 * | 12/2013 | Kaddour et al. | 102/481 |
| 2003/0205161 | A1 * | 11/2003 | Roach | 102/481 |
| 2004/0107860 | A1 * | 6/2004 | Loubser | 102/481 |
| 2005/0115443 | A1 * | 6/2005 | Rastegar et al. | 102/400 |
| 2005/0199055 | A1 * | 9/2005 | Browne | 73/170.12 |
| 2007/0151473 | A1 * | 7/2007 | Brunn | 102/444 |
| 2008/0006170 | A1 | 1/2008 | Haeselich | |
| 2010/0089272 | A1 * | 4/2010 | Cook et al. | 102/481 |
| 2010/0126887 | A1 * | 5/2010 | Kaddour et al. | 206/216 |
| 2011/0192312 | A1 * | 8/2011 | Toreheim et al. | 102/469 |
| 2012/0298005 | A1 * | 11/2012 | Kotefski et al. | 102/481 |
| 2013/0320010 | A1 * | 12/2013 | Kotefski et al. | 220/89.1 |
| 2014/0061515 | A1 * | 3/2014 | Traxler et al. | 251/11 |

OTHER PUBLICATIONS

"IM Solutions for Projectiles Crimped to Cartridges for Artillery Application—Phase II, Transition from Cartridge Case Venting to Insensitive Propellant" by Carl J. Campagnuolo, Christine M. Michienzi, Edward G. Tersine, Christine D. Knott, William J. Andrews—NDIA IM/EM Symposium, May 11-14, 2009.

* cited by examiner

GRAPH – 30mm Chamber Pressure vs. Time

TABLE – Relative Chamber Pressure (Mpa) by Ammo & Weapon

Without melting material
SM ring compressed.

Released system

Items
1- Cartridge-Case
2- Support
3- Support nuts
4- Melting material
5- SM Ring
7- Primer
8- Propellant

PRESSURE RELIEF SYSTEM FOR GUN FIRED CANNON CARTRIDGES

CROSS-REFERENCE TO RELATED APPLICATIONS

This application is a continuation-in-part of the U.S. patent application Ser. No. 12/875,402, filed Sep. 3, 2010, and entitled "Pressure Relief System For Gun Fired Cannon Cartridges." This application also claims priority from U.S. Provisional Application Ser. No. 61/239,464, filed Sep. 3, 2009, entitled "Pressure Relief System For Gun Fired Cannon Cartridges;" the aforementioned U.S. patent application Ser. No. 12/875,402, filed Sep. 3, 2010, entitled "Pressure Relief System For Gun Fired Cannon Cartridges" and U.S. Provisional Application Ser. No. 61/653,600, filed May 31, 2012, entitled "Pressure Relief System For Gun Fired Cannon Cartridges," all of which applications are incorporated herein by reference.

BACKGROUND OF THE INVENTION

The present invention relates to high velocity automatic cannon and weapon munitions having a pressure relief system.

1.0 Introduction:

The term "Insensitive Munitions" refers to a generic body of munitions knowledge that includes guidance practices, regulations, technology, methodologies and standards for complying with the following objective:

> "To ensure, to the extent practicable, that munitions under development or procurement are safe throughout development and fielding when subject to unplanned stimuli. IM are those munitions that reliably fulfill their performance, readiness, and operational requirements on demand, and that minimize the probability of inadvertent initiation and the severity of subsequent collateral damage to weapon platforms, logistic systems, and personnel when subjected to selected accidental and combat threats."

Insensitive Munitions ("IM") technology includes new energetic materials with less sensitivity to unplanned stimuli as well as mechanical and functional designs that mitigate the undesired reactions against such unplanned stimuli. Two key IM tests required by the US Department of Defense in qualification of ammunition are slow cook-off and hot cook-off tests where the ammunition is exposed to fires and the results are documented.

New munition designs should meet the standards for reducing the risks of unplanned stimuli creating a catastrophic event. There have been various developments of so-called "pressure relief" systems or "venting" devices for contained explosive and rocket motors.

Pressure relief systems in munitions, subject to unplanned stimuli such as elevated ambient temperatures, must act before the unplanned stimuli initiates an unacceptable hazard. For ammunition, the unacceptable hazard is initiation of a primer that ignites the propellant leading to separation and flight of a projectile. In a worst case scenario, the flying projectile arms and detonates. The IM venting systems work by venting the propellant, thereby reducing the efficiency of propellant combustion (burn) and precluding the flight of projectiles. Any such pressure relief system must not interfere with the normal functioning of that cartridge (munition) when fired from a family of automatic weapons.

Different solutions for venting devices or pressure relief systems for IM applications have been designed, tested and applied to a variety of munitions, be they ordnance, rockets or missiles. These solutions include concepts of melting plugs alone or in combination with burst disks, memory alloy fasteners or rings, as well as detonating cords and active venting devices using shaped charges, etc. Many applications of the concepts described have been developed on munitions ranging from grenade cartridge cases, rocket motor cases and artillery projectile bodies, to fuses and warheads. However, few such concepts have been applied to gun-fired munitions and even fewer relate to technology that disables ammunition propulsion systems in response to IM stimuli.

1.1 Prior Art:

The prior art in this field of Insensitive Munitions includes a number of articles and patents that are relevant to the present invention. Typical of such prior art is the U.S. Pat. No. 5,936,189 to Lubbers and an article "IM Solutions for Projectiles Crimped to Cartridges for Artillery Application—Phase II, Transition from Cartridge Case Venting to Insensitive Propeliant" by Carl J. Campagnuolo, Christine M. Michienza, Edward G. Tersine, Christine D. Knott, William J. Andrews—NDIA IM/EM Symposium, May 11-14, 2009.

The Lubbers U.S. Pat. No. 5,936,189 discloses a cartridge munition used with rapid-fire weapons of medium caliber (about 40 mm). Many such cartridges are received into a belt that is fed to the rapid-fire weapon. The propulsion chamber in some cartridge case types are divided into a high-pressure chamber (into which the propulsive charge is placed) and a low-pressure chamber that is connected with the high-pressure chamber via exhaust apertures. The cartridge case and projectile are mechanically connected via a central threaded connection that includes an intended break point. Other two chamber designs (such as the US M430 propulsion) use the age-old technique of crimping a cartridge to a projectile.

When the propulsive charge is ignited in the high-pressure chamber by means of a primer (igniter), the propulsive charge burns and propulsive gases are created at high pressure that then act on the projectile base in both chambers. This drives the projectile out of the cartridge case, after the break point between cartridge case and projectile is broken. A similar cartridge munition is described in Lubbers, U.S. Pat. No. 4,892,038.

The U.S. Pat. No. 7,107,909 and U.S. Patent Publication No. 2008/0006170 A1, both to Haeselich, disclose another concept for venting pressure from the cartridge case of a cartridge munition that renders the cartridge's propulsion inoperable.

Notwithstanding these references, however, the pressure relief concepts disclosed in the prior art generally concern devices for releasing pressure from warheads and rockets.

1.2 Current Concepts and their Limitations:

Most prior art references describe venting concepts for rockets, missiles, mortar rounds and grenade projectiles. None of the disclosed solutions provides both (1) venting projectile cartridge cases in a way that serves as (2) a sound solution that is usable across a spectrum of automatic cannons and weapons. Automatic weapons and cannons generally fire high velocity cartridges such as 12.7 mm SLAP, medium caliber APDFS projectiles where significant heat and pressures occur. The required containment of pressure in a cartridge case varies from weapon to weapon. For automatic weapons, heat is induced (transferred) into the cartridge case as the ammunition progresses through ammunition handling, which includes storage, feeding, chambering, function fire, ejection and extraction. In this case, the cartridge case must survive intact throughout the entire operational cycle. Large caliber projectiles (artillery and tank) fire from fully contained breach mechanisms.

1.2.1 Venting of Cartridge Cases:

Venting devices (IM plugs) with metallic melting plugs in the base of the cartridge, such as that described by Haeaelich in U.S. Pat. No. 7,107,909, are well suited for low internal pressure cartridges fired from a single shot 40 mm low velocity weapon like a M203 launcher. In this sort of hand feed weapon, the ammunition (1) does not undergo stressful ammunition handling (feeding, chambering, extraction or ejection), (2) is not exposed to high breach chamber temperatures, and (3) is not extracted inside of an automatic weapon. The solution described by Haeselich provides adequate strength as the pressures are low and the breach provides good containment and physical support of the cartridge case. The Haeselich design utilizes one or more naked metallic melting plugs made of an alloy combination of bismuth, tin (or lead). Manufacturing controls of the metallurgy provide for a consistent low temperature melting point (around 140° C.). As the metal alloy approaches its melting point, the melting plugs lose their structural strength and cannot withstand the internal pressure of the high velocity projectile in the normal operation mode of the round (function fire from an automatic weapon chamber). In addition to or instead of the use of bismuth, tin (or lead), the melting plugs may use polymers. The use of either bismuth, tin (or lead) alloys may be substituted with certain polymer plugs.

Nevertheless, in most automatic weapons and cannons a naked melting plug (as a method for creating a vent) does not provide:

(1) adequate structural integrity to the cartridge case. Structural integrity is particularly important as some cartridges are exposed to heat during ammunition handling (storage, feeding, chambering, function fire, extraction and ejection). During an automatic cannon's ammunition handling process, heat will soften fusible IM plugs and additional structural integrity is important in most automatic weapon/cannon applications;

(2) solutions for weapons where heat induced by function firing a cartridge will cause the plug in a cartridge case to disintegrate and foul the feeding of weapons;

(3) for precluding the escape of gases through the melting plug in the breach (or bolt). By preventing the breach melting condition, damage to the bolt face (or breach block) is prevented; and/or (4) optimizing the physical separation between the primer (igniter) and the propellant.

In many cases automatic weapon and cannon ammunition handling include dwell times that require cartridges to undergo an exposure to heat and even undergo chambering in a hot barrel. Therefore, an effective IM vent must function where automatic fire has heated the bolt and chamber to near the temperature in which soft metal (bismuth, tin or lead) or a specific plastic polymer undergoes a phase change to a liquid. When a phase change metal or polymer is used in non-fusible bursting plugs, the cartridge case can retain adequate structural integrity (support) as the outer walls of the cartridge case are supported by the weapon chamber. The rear of the cartridge case is typically supported by a bolt that chambers the cartridge into a chamber (or breach). Seals and the geometric configuration can provide integrity to the cartridge walls while the melted metal or polymer is in compression. This configuration, an example of which is illustrated in FIG. 16, allows the liquefied metal or polymer, encapsulated by a non-fusible material, to provide structural integrity as the IM bursting plug, while liquid, is in compression during function fire. Conversely, when a cartridge with the IM vent described herein is heated in an unsupported situation (not in a breach or held by a bolt), the IM vents will burst as intended as the liquefied metal or polymer will not be compressed against the metal surface of a weapon and the unsupported bursting plug lacks the structural integrity to contain the propellant burn.

When using memory metals, a parallel design challenge occurs. The heated cartridge and IM vent using memory metal (where it is held in compression by the automatic cannon's chamber and bolt) must provide adequate structural integrity to provide for function fire.

In addition to functioning in the chamber of a hot weapon, the cartridge case and IM plug must allow the ammunition to function properly through the entire automatic weapon cycle (storage, feeding, chambering, function fire, extraction and ejection). It is important that, after extraction, the IM vent does not disintegrate in the automatic cannon or weapon.

It is also beneficial to configure memory metal rings or bursting plugs that house an igniter (primer). In configuring a "support component" to house the primer, a designer can configure the primer to optimize physical separation prior to or preventing containment required to effectively ignite propellant powders.

1.2.2 Automatic Weapon Types, Desire for Common Ammunitions Fired from Different Automatic Weapons, Peak Operating Pressure, Integrity of Cartridges, Variations in Weapon Breaches and Cannon/Gun Chambers:

There are significant differences in the design integrity of weapons chambers and breaches. Additionally, ammunition handling system vary from weapon type to weapon type. Medium Caliber ammunition fires from:

Blow back weapons
Open Bolt weapons
Gatling Guns
Browning Gun Mechanisms
Run Out Gun Mechanisms
Chain Gun (Cannons)
Gas Feed Cannons Some weapons completely lock the ammunition into sealed breaches, while other weapons may rely on the integrity of the cartridge case to partially contain the propellant gases. Chain guns and Gatling guns can be both (self powered gas/recoil) and electrically operated. The internal pressure that higher velocity chambers and cartridges must accommodate during normal operation is in the order of 420 Mega Pascal or higher. FIG. 1 shows the burst pressure inside the cartridge case of a 30 mm munition as a function of time. Generally, the higher the internal pressure, the more likely the ammunition will fire from a sealed broach. A bolt frequently rams the cartridge into a chamber or breach providing some structural support to the base of the cartridge case. Under these circumstances, the ammunition may have some dwell in the hot chamber for an automatic weapon.

The design relationship (design constraints) among the breach, chamber and cartridge case varies from weapon to weapon. However, most automatic weapons have the following steps of in ammunition handling (SFCFFEE):

Storage
Feeding
Chambering
Function Fire
Extraction
Ejection

The following Table describes steps A-G generally used in automatic cannon feeding systems (operations). The design criteria for steps A-D entail the cartridge case providing adequate strength and integrity to provide good sealing and function in the cannon's chamber. Once fired, the design requirement shifts in that the "heated" IM plug must retain adequate structural integrity to preclude disintegration of the IM plug (spilling the melted contents into the weapon). In the case where a memory alloy (or a mix of melting plug and memory alloy) is provided, the IM plug must not disintegrate.

| Step | Time | Automatic Weapon Function Fire Steps | Heat Condition During Ammunition Handling and Operation |
|---|---|---|---|
| A | T0-T1 | Exposure of Ammunition to heat in an ammunition box (Note 1) | If outside a vehicle, ammunition box is heated by the sun. If inside a vechile heat from vehicle operating components frequently transfer heat to cartridges in an ammunition box. |
| B | T1-T2 | Feeding of Ammunition into a breach | As ammunition nears the heated chamber of a weapon, components in the ammunition handling sysytem transfer heat into a cartridge. |
| C | T2-T3 | Ammunition dwell in a chamber or bolt face (see note breach construction) | Closed bolt/breach designs chamber a cartridge where that cartridge can be in a ready position waiting for function fire. In this condition, heat (from prior cartridges fired) will heat a cartridge. With open bolt designs a cartridge case is attached to a bolt face. For recoil operated weapons, ammunition, bolt and breach move in a synchronized fashion. |
| D | T3-T4 | Function Fire | The ignition of propellant transfers significant heat into the cartridge case. |
| E | T4-T5 | Extraction | Ammunition handling systems extract the spent cartridge from the cartridge case. At this point, the cartridge case is a heat sink carrying a hot spent cartridge from a weapon. The cartridge is under high g forces as it is removed from the weapon and mechanical components extract the cartridge case via various well known ammunition handling methadologies |
| F | T5-T6 | Ejection | Ammunition is ejected from the weapon. It is generally desirable that the ammunition does not disintegrate in a manner that would foul the weapon or create a safety concern. |
| G | T6-T7 | Collection of Spent Cartridge Cases | The cartridge case cools as it moves through the air and lodges against a cooler ambient surface. |

Note 1: During step T2-T4 various breach designs heavily influence the required structural strength of a cartridge case.

Note 2: Increasing heat is transferred to the projectile and cartridge case as the ammunition undergoes ammunition handling (Steps A-C) in an automatic weapon. Function fire (Step D) imparts a significant amount of heat into the cartridge case. The cartridge case's structural strength required for Steps A-D depends on the design of a breach construction. The structural integrity after firing (Steps E and F) must preclude disintegration of components in an automatic weapon that may affect weapon function. Additionally, depending on the location where spent cartridge cases are collected, it may be desirable that debris is minimized so users may wish that spent cartridge cases do not disintegrate even after ejection.

Note 3: In Stops A-C the cartridge case should retain adequate structural integrity until function fire where the projectile separates from the cartridge case venting gases and propelling the projectile.

Note 4: In Step D the cartridge case should retain adequate structural integrity so that IM plugs (supported by the chamber or breach walls or bolt face) do not fail. The IM plugs should not fail in compression.

Note 5: In Steps E and F the cartridge case no longer must retain the strength of structural integrity required up to function fire; however, the cartridge should still retain adequate structural integrity so that the plug does not disintegrate as undergoes the ammunition handling steps of extraction and ejection. Further, it is very important that melted plug material does not adhere to weapon components where it could foul the weapon or create stoppages.

Note 6: In Step G it is generally desirable that spent cartridge cases retain their integrity so that are easily collected for disposal. The disintegration of materials could create hazardous edges and surfaces.

The variation in weapon designs and need for automatic cannon and weapon ammunition capable of being fired from a broad compatibility in multiple weapon types. This generally requires that a cartridge case retains varying degrees of structural integrity as it undergoes ammunition handling. For NATO countries, automatic weapon and cannon caliber ammunition is generally identified as ammunition in the following diameters: 20 mm, 25 mm, 30 mm. Some products like the 12.7 mm (.50 cal) and 40 mm AGLs are cross-over weapons that can be described as heave machine guns. In some cases, different cartridge case lengths are applicable to different calibers. The following paragraphs provide a summary of the principle cannon weapons in US/NATO:

1.2.2.1 .50 cal (12.7 mm):

The famous .50 cal family of weapons is one of the oldest designs still in widespread use worldwide. Two weapons dominate the market.

| Weapons/Cannons Firing 12.7 mm × 99 Ammunition | | |
|---|---|---|
| Weapon Nomenclature | Weapon Type | Rate of Fire (Rounds Per minute) |
| M2 Browning | Recoil Operated | 450-635 |
| GAU 21 (M3M) | Recoil Operated | 6000 rpm |

1.2.2.2 20 mm Cannons:

Two types of cartridges dominate the 20 mm cannon market; namely, 20 mm×102 and 20 mm×139.

| Weapon Nomenclature | Weapon Type | Rate of Fire (Rounds Per minute) |
|---|---|---|
| Weapons Cannons Firing 20 mm × 102 Ammunition | | |
| M197 Gatling | Gatling Gun | 730 rpm |
| M61 Vulcan | Gatling Gun | 6000 rpm |
| M621 Giat | Blow Back | 800 rpm |

-continued

| Weapon Nomenclature | Weapon Type | Rate of Fire (Rounds Per minute) |
|---|---|---|
| Weapons/Cannons Firing 20 mm × 139 Ammunition | | |
| KAD Oerlikon (formerly the Hispano-Suiza HS. 820) | Gas or Blowback | 600-850 rpm |
| M683 GIAT | Delayed Blowback | 720 rpm |
| MK 20 Rh 202 Rheinmetall | Gas Operated | 880-1,000 rpm |

1.2.2.2 25 mm Cannons:

25 mm like most cannon calibers must fire from many different types of Weapons/cannons with very different heat profiles, dwell times and ammunition handling systems.

| Weapons/Cannons Firing 25 mm × 137 Ammunition | | |
|---|---|---|
| Weapon Nomenclature | Weapon Type | Rate of Fire (Rounds Per minute) |
| M242 Bushmaster | Chain Gun | 200-500 rpm |
| GAU-12 Equalizer | Gatling Gun | 1800-4200 rpm |
| Oerlokon KBA $_{B02B1}$ (Rheinmetall) | Gas-operated weapon | 200-600 rpm |
| GIAT 25M811 | Externally Powered Cam Arrangement | 125-400 rpm |

1.2.2.3 30 mm Cannons:

30 mm weapons provide a useful example of the desire for standardized ammunition (within NATO) that guides ammunition design. There are two types of 30 mm cannon cartridges in US DoD service 30 mm×173 and 30 mm×113.

| Weapons/Cannons Firing 30 mm × 173 Ammunition | | |
|---|---|---|
| Weapon Nomenclature | Weapon Type | Rate of Fire (Rounds Per minute) |
| GAU 8 Avenger | Gatling Gun | 4200 rpm |
| Bushmaster Chain Gun | Chain Gun | 200 rpm |
| Rheinm 30-1/2 | Gas Operated Weapon | 700 rpm |

In many gas operated weapons (like the Rheinmetall 30-1/2) proper venting of gases is paramount to operation of the weapon.

| Weapons/Cannons Firing 30 mm × 113 Ammunition | | |
|---|---|---|
| Weapon Nomenclature | Weapon Type | Rate of Fire (Rounds Per minute) |
| ADEN MK4 | Recoil (electric primer) | 1200-1700 rpm |
| M230 | Chain Gun | 625 rpm |

1.2.2.4 40 mm AGLs:

40 mm Automatic Grenade Launchers (AGLs) like the MK19 and MK47 are cross-over weapons. 40 mm AGLs do not fire with the energy of cannons, but the weapons do fire ammunition at a rate of fire of 250-375 rounds per minute. The MK19 that uses an open bolt with advanced primer ignition only the part of the un-chambered cartridge provides structural integrity. An MK47, firing the same cartridge, is a short recoil operating system firing from a closed bolt. Therefore, the MK19's cartridge case requires greater structural integrity for firing than the MK47 as the cartridge case is not fully chambered at the time of primer ignition. An MK47, on the other hand, fires from a closed bolt (at a slower rate of fire) so ammunition fired from the MK47 has a longer dwell time in a heated chamber (breach). It is also important to realize that some weapons (like the MK19) do not automatically eject the last spent cartridge case on a belt (the last cartridge remains on a hot bolt face).

| Weapons Firing 40 mm × 53 Ammunition (High Velocity 40 mm) | | |
|---|---|---|
| MK19 | Blow Back/Open Bolt (advanced primer ignition) | 325-375 rpm |
| MK47 | Closed Bolt | 250-300 rpm |
| H&K | Blow Back/Open Bolt (advanced primer ignition) | 350 rpm |

1.2.2.5 Ammunition Standardization for Automatic Cannons and Weapons:

One should note, as illustrated in the tables above (.50 cal, 20 mm, 25 mm, 30 mm and 40 mm AGLs), that the weapon rates of fire vary greatly within each ammunition caliber family. NATO standardization is discussed below in paragraph 1.3. With the large variation in rates of fire among automatic weapon families, one will recognize that the heat produced in higher rate weapons is much greater than the heat produced in weapons with lower firing rates. In an environment where standardized ammunition is required to function from multiple weapons, an effective IM vent for medium caliber ammunition must provide for (1) venting functions in slow and hot cook-off, and (2) while functioning across a spectrum of weapons with different action times, different dwell times, where cartridges undergo different g loads as the cartridge case undergoes the storage, feeding, chambering, function fire, extraction and ejection. When considering IM ammunition solutions for ammunition fired from automatic weapons and cannons, the Haeselich design, as disclosed in the aforementioned U.S. Pat. No. 7,107,909, is inadequate. The design is not robust enough in providing structural integrity to function from automatic weapons and cannons. For automatic cannon/weapon ammunition, the design requirements are further explained herein.

1.2.3 Heat Transfers, Chamber Dwell Time and Ammunition Handling:

Some systems, such as turrets in fighting vehicles, often have ammunition feed systems where the ambient "ready" ammunition is exposed to high temperatures. Many closed (unsealed) bolt weapon designs rapidly transfer heat into cartridge cases. Weapons such as the .50 cal Browning and certain artillery types have cook-off dangers where hot barrels rapidly transfer heat to their cartridge cases. Some weapons also have slow rates of fire with extensive dwell times in a chamber. One should also note that the surface (contact area) of "hot" ammunition handling surfaces effect the heat transferred into cartridge cases. The heat produced by previous salvos is transferred into automatic weapons. Accordingly, the cartridge case and IM vent design must accommodate heat transfer into the cartridge case during storage, feeding, chambering, function fire, extraction and ejection.

1.2.3.1 IM Function:

The melting temperature of the meltable metallic or polymer plugs must be equivalent to the temperature induced by a heating of a fire (slow cook-off or fast cook-off testing). Alternatively, the use of memory metal alloy alone or in combination with a memory metal alloy should provide for venting from the cartridge case at a temperature that is lower than that of the auto-ignition in the primer (igniter), flash tube or propellant charge. Heat transfer and elapsed time influence function of the IM vents. It is also beneficial (in terms of IM effect) to the extent practicable to use the primer to energetically open the vent, thereby contributing to inadequate containment and inefficient propellant burn. Use of a bursting component with the metallic or polymer plug is critical to providing structural integrity through the ammunition handling process used in automatic weapons.

1.2.3.2 Projectile Separation:

Another condition is that the venting device must be designed to vent gas at an internal pressure lower than the pressure which drives projectile separation and flight of the projectile when the cartridge is not chambered (or the cartridge is stored in containers).

1.2.3.3 Heat Transfer and Dwell Time:

Weapons differ in the amount of heat induced into the cartridge case during feeding (ammunition handling). Heat flows into the cartridge as it undergoes storage, feeding, chambering, extraction and ejection (SFCFFEE) during automatic function fire. The dwell time in a hot chamber and area of contact surfaces can affect the structural integrity of the cartridge case (with IM plugs). An understanding of heat flow is especially important in automatic weapons cartridge.

1.2.3.4 Target IM Transition Point (Concurrent or After Function Fire):

As heat is transferred at each step of the feeding cycle, the cartridge case (with IM plug) nears the point where structural integrity will be lost. The design goal is to insure that structural containment is not lost prior to function fire. Failure of an IM plug in a chamber may result in erosion and will certainly foul the weapon's breach. For a metallic melting plug configuration, the prior art does not provide for adequate structural integrity to undergo extraction and ejection (without the raw melting plug material from oozing from the cartridge case fouling the feeding mechanisms). Post-firing induction of heat into a cartridge case may cause the IM plugs to disintegrate (melt) and foul a weapon. Quickly after function fire, the heat transferred passes the phase transition point of the melting plug and the internal contents of the plug liquefies. The liquefaction of the IM plug material results in a loss of structural integrity that is critical in some breach mechanisms. It is possible to utilize an insulating metal (like zirconium) that provides insulation to the IM plug fabricated from either a memory metal, a melting alloy or a combination thereof. Depending on a combination of factors (dwell time, heat transfer, maximum chamber temperature, for example) it may be necessary to conduct heat flows around an IM plug, thereby delaying the time period for activation of the IM plug. FIGS. 13A and 13B illustrate this timing for memory metal and fusible material, respectively.

1.2.3.5 Pressure:

In order to provide a context for the description of the high loads due to the internal pressures of certain types of weapons, and hence to understand the requirements of an IM venting design to withstand these loads, reference is made to FIG. 2, which is a table of values of burst pressures in the cartridge case for a variety of weapons and munitions.

1.2.3.6 Breach, Bolt Face and Function Fire:

The relative pressure, sealing of the breach, mechanical support provided by breach and bolts, dwell times and heating of the cartridge through the temperature cycle all influence the required structural integrity of an IM cartridge case. Where a weapon has a fully sealed breach, the breach wall and bolt face will provide important structural support (containment) of the cartridge case. In some cases, chambering into a hot breach may result in liquefaction of the fusible material in an IM plug; in this event, the bursting plug must provide for adequate structural integrity (in compression) so that the IM plug fill does not fail. Failure would spill melted material and foul the weapon mechanisms and chamber when the "spent" cartridge case undergoes extraction and ejection.

1.2.4 Risk of Residue and Weapon Fouling/Stoppages:

It is important to recognize that a melting plug should not leave residue and should not melt (or otherwise disintegrate) during SFCFFEE. After function fire ammunition undergoes ejection and extraction, the cartridge case may undergo significant g loads. The disintegration of the cartridge during post firing extraction or ejection will foul automatic weapons mechanisms. Therefore, it is desirable to have structural integrity of a melting plug through the entire post firing ammunition handling cycle (extraction and ejection). There are also shortcomings to the cooled "spent cartridges" having hazardous rough edges and surfaces.

1.2.5 Large Caliber Applications:

Some large caliber devices use autoloaders, but many other cannons still rely on human operators to feed, chamber, extract and eject the ammunition. There are experimental solutions for 105 mm Howitzer projectile cases using metallic and polymer melting plugs. See, e.g. NDIA briefing by Carl J. Camagnuolo May, 2009, posted at:

www.dtic.mil/ndia/2009insensitive/5Bcampagnuolo.pdf

It is possible that fully contained breaches that utilize Haeselich vent plugs from polymers might use melting plugs that fully vaporize during ignition; however, it is obvious that the naked bismiuth tin (or polymer) IM plugs will melt immediately after ignition and the resulting residue will foul chambers, breaches, weapons and complicate material handling. Current polymers have carbonized under the high flame temperature of burning 105 mm propellants.

1.2.6 Context of Design Challenge in Automatic Weapons and New Disclosed Art:

The fundamental design challenge to incorporate IM venting into medium caliber ammunition is identification or novel arrangements that provides:

(1) Optimized venting of the cartridge case when exposed to outside stimuli. It is desired to maximize the venting area and use the energy of the primer/igniter to enhance venting;

(2) Sound structural integrity of the cartridge case up to the point of ignition (in a automatic weapon chamber); and (3) Retention of adequate structural integrity (after the cartridge case is heated by function firing) to preclude disintegration in chamber as the cartridge case will undergo g forces when extracted from the chamber and ejection from the weapon. In this case, the structural integrity must preclude fouling of the weapon).

1.2.7 Limited Application of Haeselich:

In weapons with certain characteristics, the Haeselich design does not provide adequate structural integrity required to preclude catastrophic failure, venting propellant gases. The following three factors strongly influence an IM vent's design parameters for an ammunition type's cartridge case:

(1) Integrity of Chamber:

Some weapon/cannon chambers (breaches) are "sealed" while other weapons feed and ignite the cartridge case prior to the cartridge being fully chambered. This is sometimes described as a "closed bolt" versus "open bolt" design when discussed in the context of machine gun design. Further, design of breaches provides varying integrity. Automatic cannons have varying arrangements and the integrity of chambering and sealing varies across calibers.

(2) Pressure and Structural Integrity in Feeding and Chambering:

A cartridge's propellant gases generate high pressure. An MK19 HV cartridge will generate about 90 Mpa of pressure whereas the pressure of both medium-caliber artillery and tank ammunition varies between 350 Mpa to 650 Mpa.

(3) Induced Heat:

The heat energy transferred into the cartridge from the weapon during storage, feeding, chambering and firing requires an improved strength of design (integrity) of a cartridge. As the ammunition handling system moves the cartridge through different stations leading to chambering, the cartridge case has physical contact with ammunition handling systems and the automatic weapon (cannon) chamber. The dwell time and contact surface area of the ammunition during feeding and chambering affects the transfer of heat. Longer dwell times increase the transfer of heat into a cartridge case. During function fire a significant amount of heat is transferred into the cartridge case.

As the cartridge case ejection accelerates a "spent" cartridge case from the breach and from the weapon, such ejection carries heat away from the weapon. During post firing ejection, it is desirable to preclude melting plugs from disintegrating in the weapon, thereby leaving residue that will foul a weapon.

(4) Low and Medium Heat Systems:

An example of a low heat, low pressure, minimum dwell time projectile is the 40 mm M203. The MK19 MOD 3 system, prevalent with 40 mm weapons, is an open bolt design, where the cartridge fires in an advance primer ignition system. Therefore, 40 mm HV ammunition fired from a MK19 MOD 3 is never chambered into a hot breach. However, the cartridge may remain in the ready position on a MK19 bolt, thereby transferring some heat from the bolt to the cartridge case.

(5) High Heat/High Pressure Automatic Weapons:

Two examples of cartridges generally exposed to a high heat, high pressure system are (1) a .50 cal (12.7 mm) Browning weapon, (2) a 25 mm×137 cartridges fired from the 25 mm Bushmaster series weapons and GAU 12 weapons, and (3) 30 mm×173 weapons fired from 30 mm Bushmaster weapons, Rheinmetall weapons and GAU 12 weapons. In this case two different types of weapons require the ammunition to function (and the cartridge case to retain integrity) while the ammunition is exposed to increasing heat and under high pressures. In these two examples, it is important that the cartridge case maintain adequate structural integrity through the entire cycle of weapon feeding, chambering, function, extraction and ejection. When the cartridge functions, significant heat is transferred into the cartridge case. The expelled cartridge case carries heat from the weapon.

Any attempt to incorporate the Haeselich IM solution into most medium caliber weapon/ammunition combinations will not work as the solution does not provide adequate structural integrity through the entire SFCFFEE cycle. Therefore, the potential application of the Haeselich design with automatic weapons is very limited.

1.3 Other Shortcomings of Haeselich:

The Haeselich U.S. Pat. No. 7,107,909 does disclose an IM design with sufficient structural strength to enable the cartridges to function adequately at low pressures in low heat single shot weapons. However, the design does not provide adequate structural integrity for broad application in automatic cannons and weapons. In addition to the shortcomings identified in paragraphs 1.2, the Haeselich melting plug approach has other practical shortcomings and limitations:

(1) The venting areas are small, requiring the provision of multiple plugs in a cartridge case; and (2) The venting device does not provide for a physical separation of the primer from the propellant powder.

(3) The actual process of igniting a cartridge rapidly heats a cartridge case. In firing, a tremendous amount of heat is transferred into the now "spent" cartridge case. When the "heated" cartridge is extracted and ejected, heat is carried away from the chamber of the automatic cannon. It is desirable that the "spent" cartridge case have adequate structural integrity so that the naked melting plug does not disintegrate, allowing ejection of the cartridge case in a manner that keeps the weapon free of debris and materials. Splatter from melted alloys or carbonized polymers can foul weapons.

Generally speaking, it is possible to identify primers (igniters) that under heating will initiate before powder burning. In this case, it is beneficial to use the action of the primer initiation to physically propel the plug primer sub-assembly away from the cartridge creating a greater physical separation from the powder.

For the previously disclosed designs, it is important to understand that heat "builds up" during the firing process. Cartridges are generally chambered into a weapon that may have a great deal of heat. Heat is quickly transferred through thin-walled cartridge cases. In this case the Haeselich solution is optimized for 40 mm LV ammunition fired from M203 type launchers.

While the Haeselich design has been an important step forward and functions with single shot, low pressure, low heat producing projectiles like a 40 mm×46 LV cartridge fired from an M79, M203, M320 single shot launchers or similar weapon, it is desired to have IM venting solutions that allow for a broad use of cartridges in automatic cannons and automatic weapons. Robust solutions will provide for IM venting in an environment where cannon caliber ammunition must undergo stressful ammunition handling and function from many different types of automatic cannons and weapons. Users in the United States Department of Defense and NATO militaries have standardization programs and promulgate STANAGS (Nation Standardization Documents) that provide requirements for ammunition computability among NATO militaries. Generally, the NATO standardization documents (STANAGs) set requirements by caliber and ammunition type for function fire compatibility among multiple automatic weapons.

NATO STANAG Ammunition Compatibility Documents by Caliber

| Ammunition Type | NATO Document |
|---|---|
| .50 cal 12.7 mm Ammunition | STANAG 4383 |
| 25 mm × 137 Ammunition | STANAG 4173 |
| 30 mm × 173 Ammunition | STANAG 4624 |
| 40 mm × 53 HV Ammunition | STANAG 4403 |

1.4 Design Objectives of the Present Invention:

For the cartridge designer working to optimize IM venting (in slow cook-off and fast cook-off conditions), the fusible material must liquefy for the IM vent to become "operational." When discussing ammunition propulsions undergoing slow cook-off conditions the propellant generally becomes unstable and initiates the 1$^{st}$ energetic event. In fast cook-off conditions, the primer (or igniter) may initiate first energetic event. Generally speaking, the IM event will occur at lower temperatures in slow cook-off testing. Liquefaction of the IM fusible material at a temperature in the range of 140° C. results in a reduced structural integrity in the IM vent with busting plug. With the 1$^{st}$ energetic reaction (either primer/igniter initiation or propellant burn) the bursting plug fails, venting the expanding propellant gases. One can generally expect slow cook-off initiation to take place after a cartridge reaches 140° C. Better propellants could eventually increase the temperature where slowly heated propellants ignite; however, the temperature of 140° C. is identified herein as the temperature range that IM cartridge case should vent.

Cartridge function (key parameters):

Integrity of strength up to function fire;

Integrity of strength (post function fire) to preclude disintegration during extraction and ejection;

Maximum temperature of the cartridge through SFCFFEE; and

Cost effectives of the solution.

Again, it is critical that the design retains adequate cartridge case structural integrity through the cycle of feeding, chambering, function fire, extraction and ejection (automatic weapon fire). The need for structural integrity extends to post function fire extraction and ejection to preclude disintegration of materials after function fire that could lead to fouling of the weapon (or other stoppages).

To summarize, an efficient solution for a venting device for munitions, including high velocity projectile cartridges with high internal pressures (with higher heat conditions found in automatic weapons), must achieve the following operating conditions in order to provide an IM Class V response:

(1) The venting device in the base of the cartridge case should provide the same structural integrity as a standard case when it is feed, chambered, fired, extracted and ejected from an automatic weapon.

(2) The venting device should perform its function to expel the gases at a cook off temperature lower than the one which produces the auto-ignition of the secondary explosive of the booster and hence the main propellant charge.

(3) The venting device should perform its function, creating a large venting area such that the internal pressure in the cartridge produced by an accidental ignition of any of the propellant (energetic) materials in the cartridge never exceeds the value of the internal pressure in the cartridge that would cause the projectile to separate and be propelled through the air with substantial velocity.

SUMMARY OF THE INVENTION

It is a primary objective of the present invention to design a family of Pressure Relief Systems (PRS) for an IM cartridge cases that function from automatic weapons and cannons which is comprised of:

(a) a cartridge case having a base and an upper portion forming a propulsion chamber;

(b) a projectile having a base inserted into the upper portion of the cartridge case and mechanically connected thereto;

(c) a propulsive charge disposed in the propulsion chamber of the cartridge case whose propulsive gases exert a force on the base of the projectile when they burn causing the projectile to be driven out of the cartridge case; and (d) an igniter or primer disposed in the base of the cartridge case for igniting the propulsive charge.

A further objective of the present invention is to provide a cartridge munition of the above-noted type with an effective and reliable solution to vent gases from the cartridge case in the event that the cartridge causes temperatures reach or exceed about 140° C. where the primer or igniter will self-ignite.

It is a further objective of the present invention to provide an IM cartridge munition having a cartridge case with structural integrity. It is the objective that prior to function fire, the cartridge case (with an IM plug) has structural integrity to function correctly from a family of weapons. It is further objective that the cartridge with IM plug functions when chambered into a hot breach. After function fire, it is the objective that the cartridge case (with IM plug) retains adequate structural integrity to preclude disintegration and subsequent fouling of automatic weapons and cannons.

It is a further objective of the present invention to provide alternative configurations of an IM cartridge that provides a support structure that optimizes venting of a igniter (primer or flash tube).

It is a still further objective of the present invention to provide an IM cartridge munition wherein the structure holding the igniter is released (or ejected) when its PRS is activated.

These objectives, as well as further objectives which will become apparent from the discussion that follows, are achieved, in accordance with the present invention, by providing a cartridge munition with passages that exit from the propulsion chamber and penetrate the wall of the cartridge case. These passages are filled with a solid, pressure-tight, fusible filler material, the melting point of which is lower than the minimum ignition temperature of any pyrotechnic charge in the munition; i.e., lower than the ignition temperature of the pyrotechnic igniter charge and the propulsive charge. One or more rupturable, non-fusible, pressure relief members that add additional mechanical support are positioned between the fusible, solid, pressure-tight material and the propulsive charge.

The rupturable support or relief members are preferably positioned adjacent the fusible filler material; that is, between the fusible filler material and the propulsive charge or propellant. More specifically, the fusible filler material is either "capped" by, or "enclosed in" a non-fusible material of the support or relief member, such as a disk, a cap, or an annular ring. The resulting assembly, that is, the non-fusible metal relief member and the fusible filler material, provides a useful solution to support the propellant, when appropriate, but prevents unwarranted ignition of higher pressure types of ammunition.

The pressure relief members (unsupported bursting plug or memory metal reaction reducing structural support) are designed to fail when the $1^{st}$ energetic event followed by the $2^{nd}$ energetic event in a well-vented configuration. For slow cook-off testing, propellant self-initiation will create the $1^{st}$ energetic event followed immediately by initiation of the primer. For fast cook-off tests, the primer may initiate before the powder. In these circumstances, the relief members facilitate venting of propellant gases either (1) to preclude separation of the projectile from the cartridge case or (2) to significantly reduce the energy (velocity) of a projectile. This disabling characteristic prevents inadvertent fuse function (because the "set-back energy" is inadequate to provide for fuse function), which prevents detonation and precludes possible loss of life. The fusible material is preferably a fusible metal or polymer. Such fusible metals that are useful according to the invention include alloys of bismuth and tin. Lead or alloys thereof, etc., may also be used. New polymers such as polymide start to melt at in the correct range. When coupled to a bursting plug the polymer or metal plug a practical, producible IM vent with adequate structural integrity.

If a cartridge of the type described herein is heated to the melting temperature of the fusible material or metal, for example, to about 140° C., then the fusible material in the passages within the cartridge case, that connect the propulsion chamber to the outside, melts. If the temperature continues to increase and the primer (or igniter) and subsequent propellant charges are ignited, then almost no significant pressure will build up within the propulsion chamber because the freed passages function as pressure-relief apertures. The result is that after primer initiation, the propellant (propulsive) charge burns inefficiently, and the propulsive gases generated escape via the pressure-relief apertures. Consequently, the cartridge cases and projectiles are not separated from each other, so that the projectile does not fly. For ammunition with fuzed ammunition, the failure to fly from the projectile means that and safe arm devices (in operational fuzes) do not engage and move detonators (in flying projectile) into alignment. Therefore, this propulsion disabling concept precludes the inadvertent high order detonation of ejected operational projectiles.

The passages between the propulsive charge and the outside of the cartridge case may be configured in many different ways. For example, the housing of the igniter cap may be made of such a fusible material or metal. Also, pressure-relief apertures around the igniter cap may be filled with the fusible material. Either two or four apertures are recommended for one embodiment of the invention. Another option is to provide apertures from the propulsion chamber penetrating the sidewall of the cartridge case.

However configured, the passages and ruptureable members must be so shaped and configured so that, during a normal shot of the projectile out of the cartridge case, the fusible material and non-fusible ruptureable members withstand the high pressures within the propulsion chamber. Resistance to pressure may be increased by configuring the passages for the fusible material to be conical, decreasing toward the outside, or as stepped or threaded holes.

In one preferred embodiment of the invention, a cartridge munition comprises a case projectile inserted into the cartridge case and mechanically connected to the cartridge shall, wherein a primer or pyrotechnic propulsive charge is located in a propulsion chamber of the cartridge case that is ignited by means of a pyrotechnic igniter, and whose propulsive gases exert a force on the base of the projectile when they burn, by means of which the projectile is driven out of the cartridge case. Passages exit from the propulsion chamber through the cartridge case that are filled with a fusible, solid, pressure-tight material whose melting temperature is lower than the ignition temperatures of the pyrotechnic igniter and the propulsive charge of the projectile. At least one non-fusible, ruptureable member is positioned between the fusible, solid, pressure-tight material and the propulsive charge.

In another embodiment of the cartridge munition of the invention, the fusible solid material is a fusible metal.

In another embodiment of the cartridge munition of the invention, fusible material is an alloy of at least bismuth and tin.

In another embodiment of the cartridge munition of the invention, fusible material is polymer having a melting point about 140° C.

In another embodiment of the cartridge munition of the invention, the fusible material is a bismuth/tin alloy with from about 30 to about 40% by weight of bismuth and from about 60 to about 70% by weight of tin, having a melting point of from about 140° C. to about 175° C.

In another embodiment of the cartridge munition of the invention, the passages are channels that extend from the base of the propulsion chamber to the outer base of the cartridge case.

In another embodiment of the cartridge munition of the invention, the channels are positioned around the igniter of the propulsive charge.

In another embodiment of the cartridge munition of the invention, the channels narrow as they progress from the base of the propulsion chamber to the exit.

In another embodiment of the cartridge munition of the invention, the channels narrow conically.

In another embodiment of the invention, the channels are stepped drillings.

In another embodiment of the cartridge munition of the invention, the non-fusible, ruptureable members are disks or caps or they comprise an annular ring.

In another embodiment of the cartridge munition of the invention, each non-fusible, ruptureable member is made of a thin wafer, scored or weakened.

In another embodiment of the cartridge munition of the invention, each non-fusible, ruptureable member is made of metal or of a rigid polymeric material.

In another embodiment of the cartridge munition of the invention, the metal is copper, steel, stainless steel, aluminum or brass.

In another embodiment of the cartridge munition of the invention, the polymeric material is a polycarbonate or polystyrene polymer or copolymer thereof.

In another embodiment of the cartridge munition of the invention, at least one of the passages exits from the propulsion chamber through a sidewall of the cartridge case.

In another embodiment of the cartridge munition of the invention, the ruptureable member comprises a solid material with sufficient strength to sustain normal function fire (from automatic weapons) at temperature environments encountered up to the point of chambering.

In another embodiment when the cartridge mention of invention reaching a temperature range a phase change of fusible material or shape change for memory metal creates an absence of mechanical support.

In another embodiment of the cartridge munition of the invention, the ruptureable member comprises a solid material that has been modified to prevent sustaining normal operating pressures in the absence of additional mechanical support.

In another embodiment of the cartridge munition of the invention, the ruptureable member comprises a solid material that provides structural integrity to the cartridge case (after the fusible material melts or memory metal activities) so that the cartridge case does not disintegrate in during automatic cannon extraction, ejection.

In another embodiment of the cartridge munition of the invention, the ruptureable member is made from the cartridge casing material by incomplete penetration of at least one passage exit.

In another embodiment of the cartridge munition according to the invention, each passage is filled with a pressure-tight assembly comprising a solid, non-fusible rupture disk or cap that is mechanically reinforced by a fusible, solid material whose melting temperature is lower than the ignition temperature of the pyrotechnic igniter and the propulsive charge of the projectile.

In another embodiment of the cartridge munition of the invention, the pressure-tight assembly is removable by threaded or other mechanical means.

In still another embodiment of the invention the cartridge munition includes a pressure release system having means for retaining the igniter in the base of the cartridge case, and releasing it, allowing the propulsive gases to vent, if they reach an elevated temperature, lower than the ignition temperature of the igniter and the propulsive charge, and present a risk of self-ignition. According to the invention this retaining and releasing means includes a retaining ring made of shape memory material that surrounds the primer (or igniter) and changes its diameter upon reaching the elevated temperature, thereby enabling easy separation of the igniter from the base of the cartridge case. This retaining ring can either reduce its diameter upon attaining the elevated temperature or increase it, depending upon the material from which it is made.

According to a preferred embodiment of the invention, the pressure release system further comprises a primer (or an igniter) support surrounding and holding the primer (or igniter). The retaining ring surrounds and retains the igniter support in the base of the cartridge case and releases the igniter support upon reaching the elevated temperature.

In this embodiment the retaining ring is advantageously supported, in part, in the base of the cartridge case by a fusible, solid material that melts at the elevated temperature.

Additionally the pressure release system further includes at least one ring-shaped nut, having external threads configured to engage with internal threads in the base of the cartridge case, which serves to fix the retaining ring in the cartridge base.

Advantageously, heat flow in the cartridge munition is directed around a venting IM plug by use of zirconium or a similar metal with low heat transmission properties which provide for delayed weakening of the plug while in a hot barrel. In some cases, this delay is useful to preclude disintegration of the cartridge case in some weapon combinations.

Finally, in still another embodiment of the present invention, a memory metal ring is inserted between the cartridge case and the projectile to which it is crimped. The memory metal ring expands on heating, dislodging the projectile from the cartridge case and thus preventing undesired or accidental discharge of the projectile at elevated temperatures. When the munition is chambered the ring is unable to expand and the cartridge is prevented from separating except by firing through the barrel.

For a full understanding of the present invention, reference should now be made to the following detailed description of the preferred embodiments of the invention as illustrated in the accompanying drawings.

DETAILED DESCRIPTION OF PREFERRED EMBODIMENTS

Figure 1:
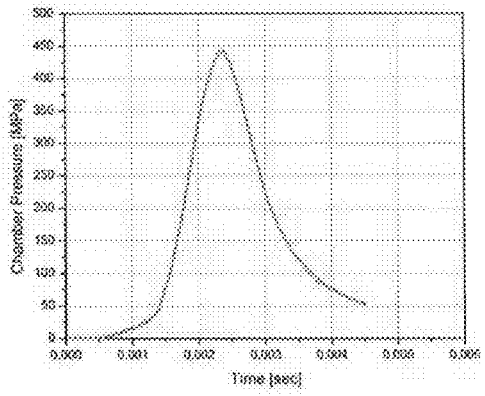
FIG. 1 is a graph showing the burst pressure inside the cartridge case of a 30 mm munition as a function of time.
Figure 2:
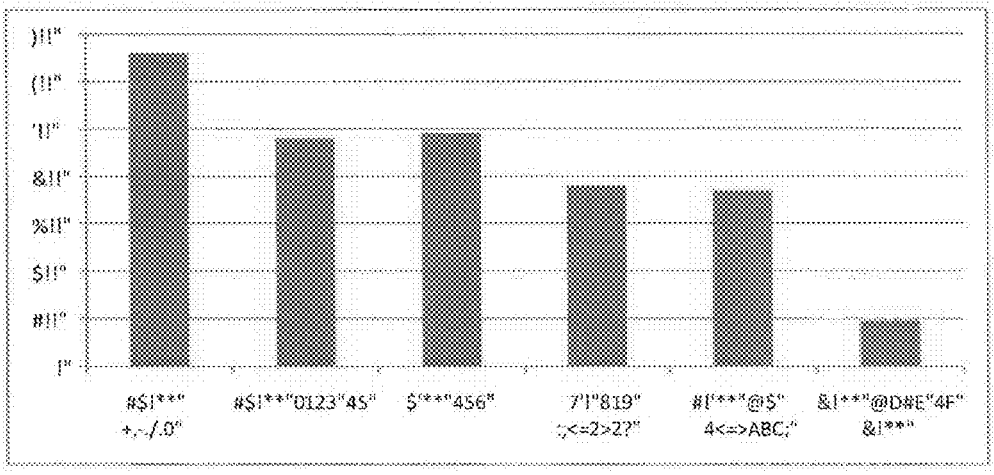
FIG. 2 is a table of values of peak pressures in the cartridge case for a variety of weapons and munitions.

The preferred embodiments of the present invention will now be described with reference to FIGS. 3-17 of the drawings. Identical elements in the various figures are designated with the same reference numerals.

Figure 3:
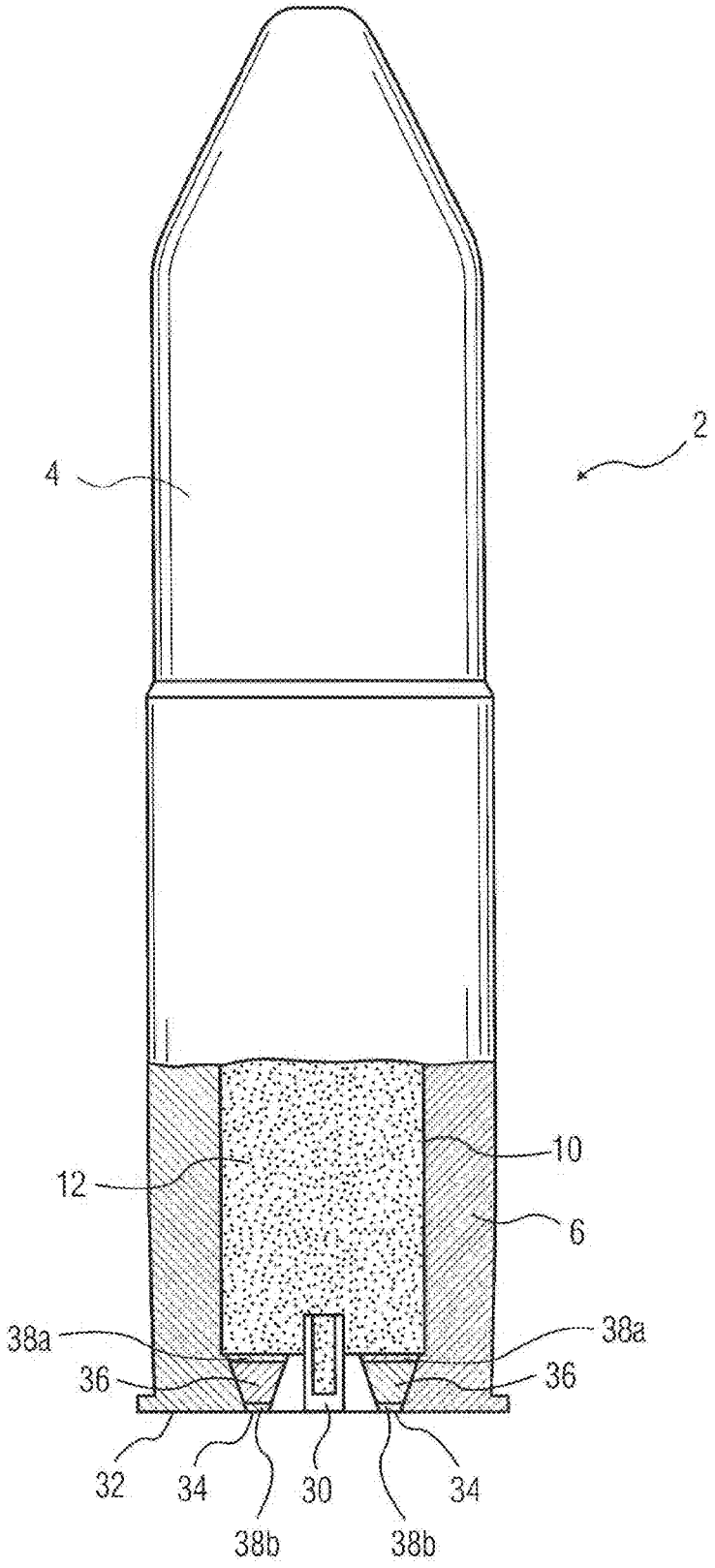
FIG. 3 is a longitudinal section through a cartridge munition consisting of a projectile and a cartridge case that incorporates a propulsion chamber with a propulsive charge whereby, according to a first embodiment of the invention, a non-fusible ruptureable member and pressure-relief apertures are provided between the propulsion chamber and the outer wall of the cartridge case.

A. Composite Melting Plug Pressure Relief System ("PRS"):

A cartridge munition 2 shown in FIG. 3 comprises a projectile 4 and a cartridge case 6. Cartridge case 6 includes a propulsion chamber 10 in which a propulsive charge 12 is positioned.

Cartridge 2 possesses a caliber of from 40 mm, for example, and is fired from a tube weapon (not shown) where the barrel has rifling (twist), the purpose of which is to engage the lans and groves in the barrel exerting a rotation on the projectile (indicated only).

Propulsive charge 12 is ignited pyrotechnically by means of an igniter (or primer) cap 30 whereby igniter (or primer) cap 30 is mounted in the center of the base 32 of cartridge case 6.

Passages are provided between the propulsion chamber 10 and base 32 of cartridge case 6. Here, conical channels 34 decrease in size in the direction of base 32 of cartridge case 6. Channels 34 possess a diameter of 7 mm for a 40 mm-caliber projectile, for example, and narrow down to about 6 mm.

By way of example, two, three, or four channels 34 are provided, symmetrical to the central longitudinal line or axis of projectile 2 and to igniter cap 30. Channels 34 are positioned symmetrically around igniter cap 30. Passages 34 are filled with a fusible metal 36.

A ruptureable or frangible disk or cap 38A is positioned between (1) the fusible metal 36 in the channels 34 and (2) the propulsive charge 12, and another disk or cap 38B is positioned at the outer openings of the channels 34. Each disk or cap 38A and 38B provides extra support for the fusible metal 36 in the channels 34. This is especially important in the case of a high pressure munition so that fusible metal remains intact prior to an increased temperature condition.

The fusible metal 36 is, for example, a bismuth/tin alloy with from about 30 to about 40% bismuth by weight and from about 60 to about 70% tin by weight. Dependent upon the blend, the melting point of this alloy is 140° C. The alloy is impact-resistant and not soluble in water. Commercially available solder alloys such as INDALLOY® 255, a bismuth-lead alloy, and INDALLOY® 281, a bismuth-tin alloy, both products of Indium Corporation of Utica, N.Y., are useful as fusible metals according to the invention.

The fusible metal 36 is cast into channels 34 after appropriate heating. Alternatively, conical rivets are made of the fusible metal that are then driven or screwed into channels 34.

Disk or cap 38 is intended to fail when mechanical support is removed, that is, when fusible material 36 melts. Disk or cap 38 comprises a metal or other rigid material, such as a polymeric material, that is adequate for containment of propulsive charge 12 in the absence of fusible material 36 melting but then is scored, weakened, or otherwise designed to fail when fusible material 36 melts. The cap precludes the alloys (that may become soft after cartridge ignition) from melting and fouling the weapon. Suitable materials for annular disk or cap 38 include, but are not limited to, metals such as copper, steel, stainless steel, aluminum, or alloys thereof, such as brass, or certain polycarbonate or polystyrene polymers or copolymers.

Propulsion chamber 10 is tight and pressure-resistant toward the exterior by means of fusible metal 36 so that cartridge 2 may be fired from a tube weapon in the same way as a conventional cartridge. The combination of the conical shape of channels 34 and annular disks or caps 38 prevents fusible metal 36 from being forced from channels 34 by the high pressure in the propulsion chamber.

As mentioned above, when the ambient temperature near the cartridges rises to from about 140° to about 175° C. as the result of a fire, for example, then fusible material 36 within channels 34 melts, freeing them. When the temperature of the igniter cap 30 then continues to rise to above about 220° C., it ignites, also igniting propulsive charge 12. The propulsive gases, created when propulsive charge 12 burns, may be diverted without consequence through each disk or cap 38 and free channels 34, so that no pressure may build up within the propulsion chamber, and therefore propulsive charge 12 is also not triggered. Cartridge case 6 and projectile 4 further remain mechanically connected via the threads 24 and 26 so that no major damage can occur due to neither the high pressure nor to separation of the cartridge case 6 and projectile 4.

Figure 4:
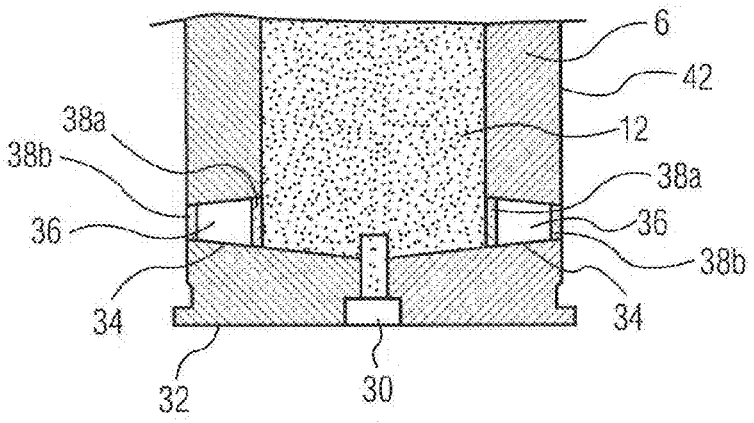
FIG. 4 is a partial representation of a second embodiment of a cartridge munition according to the invention wherein the pressure relief apertures extend to the lateral surfaces of the cartridge case.

FIG. 4 is a schematic representation of a partial cross-sectional view of a cartridge case 6 representing another embodiment of the invention. Channels 34 with fusible material 36 extend radially to the outer perimeter 42 of cartridge case 6. Disks or caps 38, or optionally an annular ring comprising the relief member (not shown), are positioned between fusible metal 36 and propulsive charge 12. In this embodiment there can be from two to four channels 34 symmetrically arranged around cartridge 6.

Figure 5:
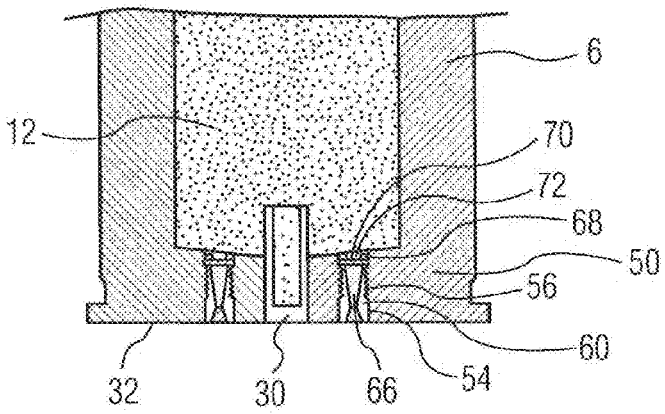
FIG. 5 is a partial representation of a third embodiment of a cartridge munition according to the invention wherein the pressure relief apertures extend to the lateral surfaces of the cartridge case.

FIG. 5 is a partial schematic representation of a third embodiment of the invention. In the base 50 of cartridge case 6 each cylindrical channel 54 with threads 56 receives a cylindrical insert 60 having reciprocal threads 62. Each cylindrical insert 60 has a conical interior shape to receive fusible material 66. Also, each cylindrical insert 60 has a recess 68 that accommodates a non-fusible, rupture-able disk 70 and a sealing O-ring 72. When cylindrical insert 60 is screwed into position within cylindrical channel 54, sealing O-ring 72 will be deformed and disk 70 will be sealingly adjacent propulsion charge 12. The arrangement shown in detail in FIG. 5A.

In this embodiment there can be from two to four channels 54 symmetrically arranged around cartridge case 6.

The cartridges in FIGS. 4 and 5 may also be fired in the same way as a conventional high velocity cartridge. In case of fire or similar problem, the function is the same as described in connection with FIG. 3.

It is also possible, of course, to use other low melting point materials as fusible material 36 instead of the bismuth/tin alloy mentioned as long as it is strong enough to seal the pressure-relief channels completely so that a normal shot is possible from a tube weapon.

B. Combined Shape Memory Alloy Ring and Composite Melting Plug PRS:

Insensitive Munitions ("IM") technology is demanding innovative solutions in pressure relief systems ("PRS") to mitigate the hazards of explosion (blast) and kinetic effects (high velocity fragments) due to unexpected events defined in IM policies.

According to the present invention an IM PRS has been developed for a projectile cartridge using smart materials (including a shape memory alloy) in combination with a melting support plug that achieves the various objectives of the invention as well as the three operating conditions described above.

This IM PRS cartridge has been designed for a 30 mm high pressure munition as a reference case. It should be emphasized that this PRS concept, as described below and illustrated in FIGS. 6-12, creates a most challenging design problem for this projectile cartridge, due to its geometrical constraints as well as the pressure variations from burst pressure to the pressure acting in the cartridge case outside the barrel in the event of unexpected thermal stimuli that would normally cause to the projectile to fly away.

It is evident that for large caliber projectiles, this concept is less demanding from the point of view of stresses and geometric constraints.

Figure 6:
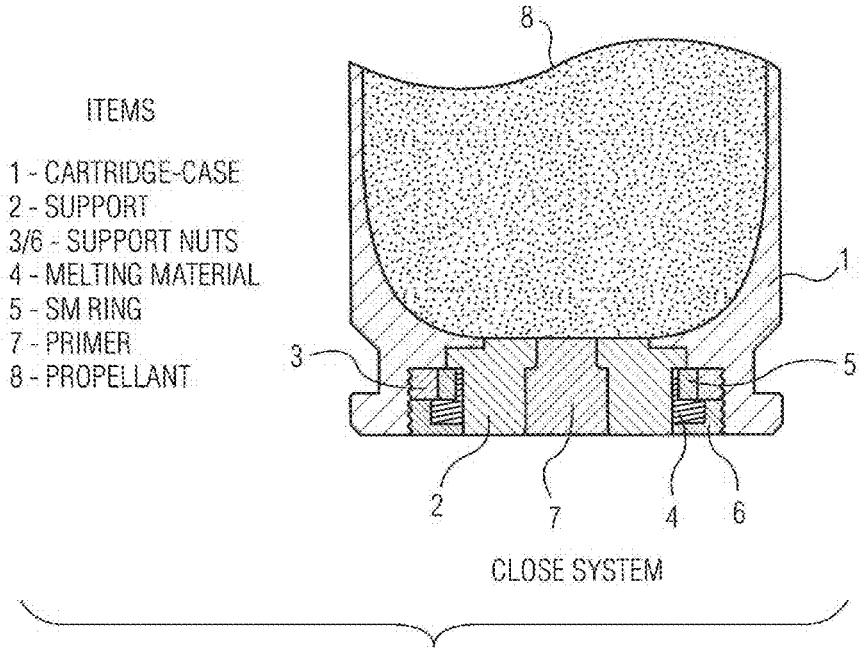
FIG. 6 is a partial representation of a fourth embodiment of a cartridge munition according to the invention having a PRS comprising a shape memory alloy ring embedded in melting material. The ring is designed to contract upon reaching an elevated release temperature.

FIG. 6 illustrates this PRS design, with the main components thereof listed and identified in the figure.

This PRS design comprises an assembly of a cartridge case 1 holding, by means of a support 2, an igniter (flash tube and/or primer) 7 and a propellant 8. The PRS employs a shape memory alloy (contracting) ring 5 and a composite melting material plug 4 and is therefore referred to herein as a "combined PRS."

As shown in FIG. 6 this combined PRS is assembled using the following components:

(1) A contracting ring 5 (made of a shape memory alloy);
(2) A melting material plug 4 (made of a composite material);
(3) A circular support 2 surrounding and holding the igniter 7; and
(4) Ring-shaped support nuts 3 and 6 that retain the assembly within the cartridge case.

For normal operation the internal pressure in the cartridge case is withstood by the assembled set of components of the PRS. The operational pressure is transferred by shear forces acting on the contracting ring to the frontal nut and through the melting material plug to the rear nut. The PRS is thus able to maintain the integrity of the pressure chamber.

Figure 7:
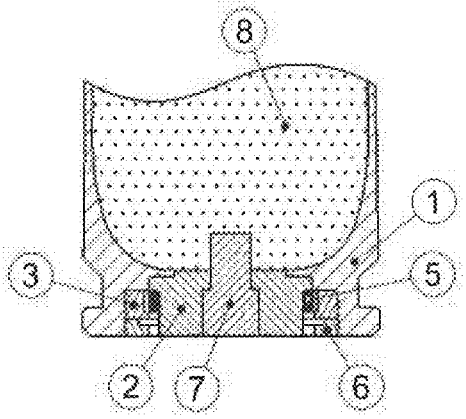
FIG. 7 is another representation of the fourth embodiment of FIG. 6 illustrating a first phase in the process of release.

When exposed to a specific heat range (above the normal handling and operating range and below the auto-ignition temperature), the composite material plug 4 melts allowing the contracting ring 5 to contract against the circular support 2. FIG. 7 shows the cartridge in this stage of operation.

Figure 8:
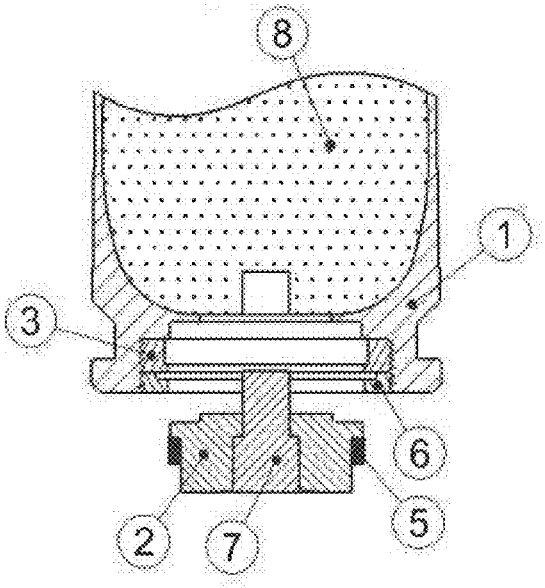
FIG. 8 is another representation of the fourth embodiment of FIG. 6 illustrating a second phase in the process of release.

The memory metal of the ring 5 contracts producing a mechanical force that expels the assembly. The expelled assembly creates a large venting duct. As the temperature rises, auto-ignition occurs and gases are vented from that duct, preventing them from propelling the projectile and causing it to fly away. This stage of operation is shown in FIG. 8.

When the expelled assembly creates a vent at the rear of the cartridge, the igniter (primer or flash tube) increases its physical distance from the propellant. This physical separation provides for a more predictable auto-ignition sequence and the physical separation further reduces the pressure of propellant gases.

The trigger temperature for the PRS is determined by a thermal simulation model using computational mechanics, using as input the heat flow rate provided in the standards for the fast and slow cook-off tests. The shape memory alloy composition can be customized to contract at that specific temperature and consequently will not suffer any noticeable change in its geometric dimensions due to the increasing heat flow until that temperature is reached.

In the preferred embodiment of this combined PRS, the following materials were employed:

(1) Support 2 and nuts 3,6: steel;

(2) Melting material 4: polyamide reinforced with high strength fibers; and (3) Memory alloy contracting ring 5: titanium-nickel alloy.

The cartridge case and projectile were made of conventional materials.

In order to verify this design concept and the component geometry as well as the material selection, a finite element model was developed and the stress and strain were calculated.

The results of those tests show that the stresses in the components are below 500 MPa, which is compatible with the ultimate tensile strength of the selected materials (steel, memory alloy and composite material).

Calculation of the stresses and displacement of the complete PRS and the cartridge case for the most demanding load case, which is the normal operation of the munitions with a peak internal pressure of 460 MPa, demonstrates that the maximum Von Mises stresses on the ring are under 500 MPa.

C: Shape Memory Alloy PRS Rings:

Two other designs complete the family of PRS for medium/high pressure cartridge cases according to the invention.

The PRS designs described below are intended to be used in cartridge cases which are less demanding for structural integrity than the one described above and referred to as the "combined PRS" using both a shape memory alloy ring and melting composite material plugs.

In these additional embodiments a shape memory alloy (SMA) ring 5 is located as a structural part linking the cartridge case 1 and the support 2 which is released in the event of an unexpected thermal stimulus.

One embodiment employs an expansion fastener ring (FIG. 10) and the other uses a contracting fastener ring (FIG. 11) surrounding the support 2 for the primer 7.

In both designs the SMA ring 5 is triggered to either expand or contract, respectively, at a specific temperature according to the results of the thermal simulations for fast and slow cook off environments. At the elevated release temperature, the expansion (or contraction) creates a vent in the cartridge case. Auto-ignition ignites the propellant (or primer or flash tube) and the vent releases the hot gases. Consequently the cartridge case does not contain the rapid expansion of the propellant gases leading to projectile separation and flight. The energy is imparted into the projectile and dissipated, precluding flight of the projectile with the warhead and minimizing damage to the launch platform or storage location.

Figure 9:
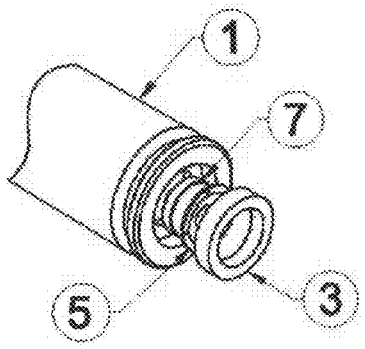
FIG. 9 is an assembly diagram showing part of a fifth embodiment of a cartridge munition according to the invention having a PRS comprising a shape memory alloy ring without melting material. The ring is designed to expand upon reaching a release temperature.
Figure 10:
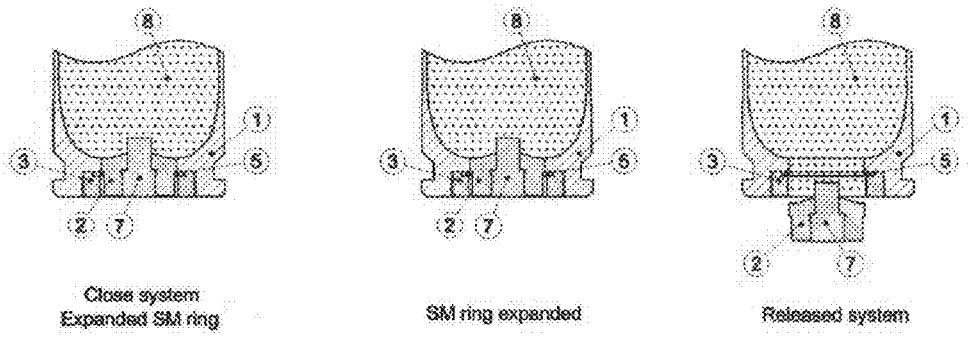
FIG. 10 is another representation of the fifth embodiment of FIG. 9 illustrating the normal configuration of the PRS and the configurations thereof in the first and second phases of release.
Figure 11:
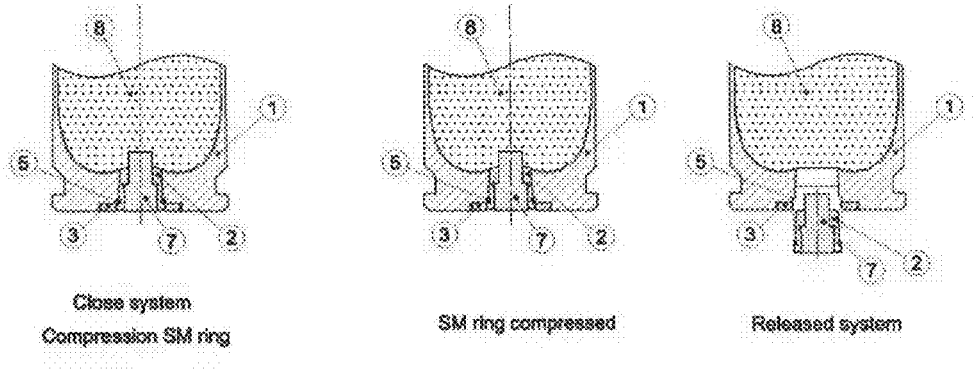
FIG. 11 is a representation of the sixth embodiment of the invention illustrating the normal configuration of the PRS and the configurations thereof in first and second phases in the process of release. This embodiment includes a shape memory alloy ring, without melting material, which is designed to contract upon reaching a release temperature.

FIG. 9 shows the elements of these two alternative embodiments in perspective view. In the associated item list, the number 4, referring to the "melting material," is included in order to provide the same numbering as in FIG. 6, despite the fact that in these embodiments there is no composite melting material.

Figure 12:
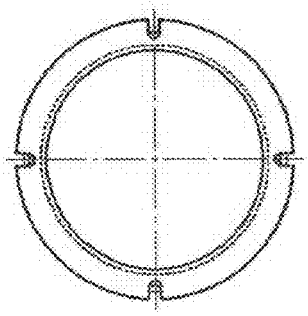
FIG. 12 is an end view of a retaining ring showing longitudinal grooves symmetrically arranged around the outside surfaces.

The fastener rings are designed in both embodiments with four grooves, as shown in FIG. 12, in order to hold the ring in the proper position and guide it to move in the right direction when it is expanding or contracting, respectively, not allowing a potential interference that could prevent the PRS from releasing freely.

As in the case of the embodiment of FIGS. 6-8, these PRS embodiments also create a large venting area when compared with other solutions for IM venting.

Figure 13A:
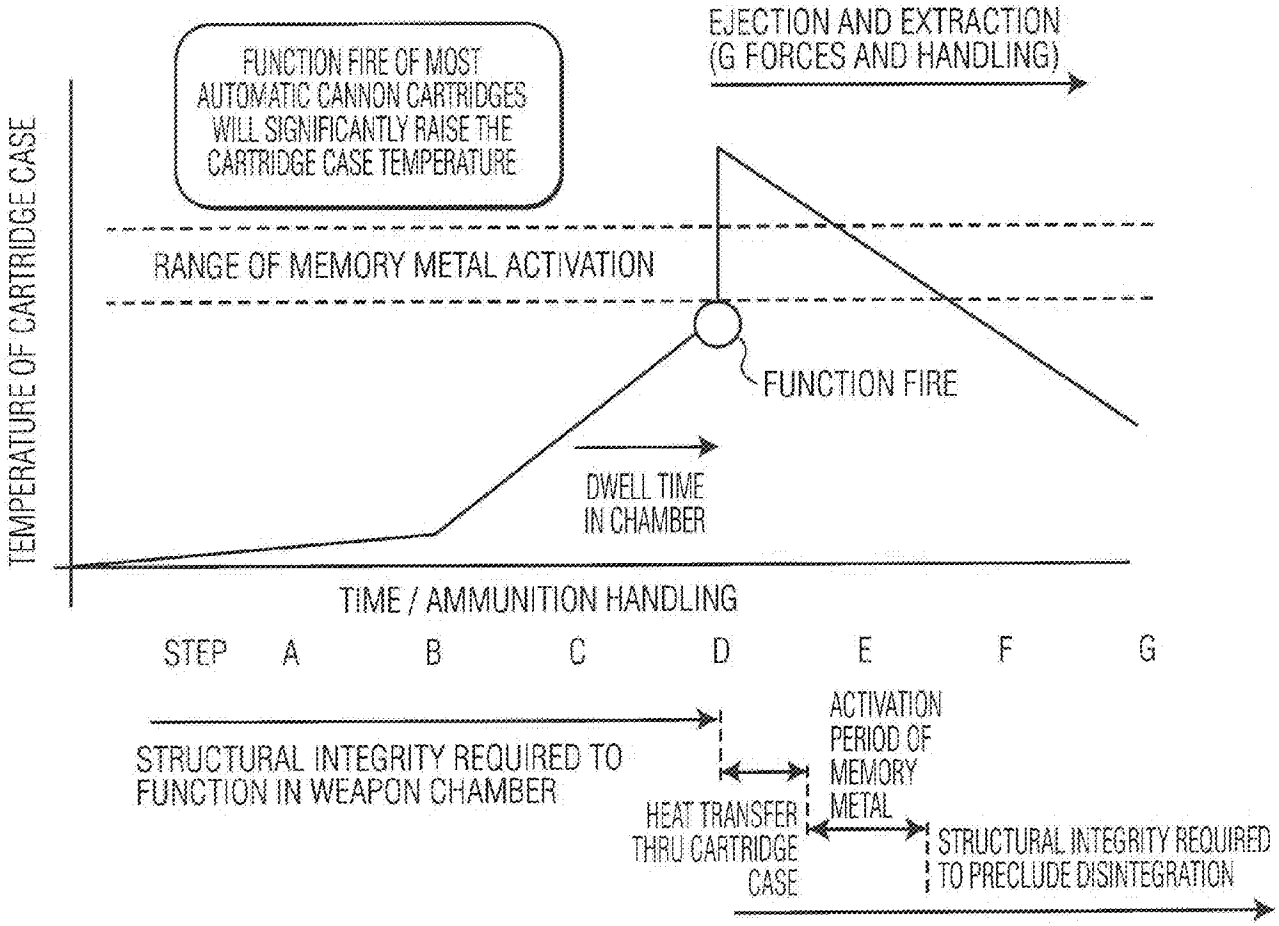
FIGS. 13A, 13B and 13C are time diagrams showing the temperature of a cartridge case and the response of memory metal, IM plug and phase shift material, respectively, in an IM venting system according to the present invention.
Figure 13B:
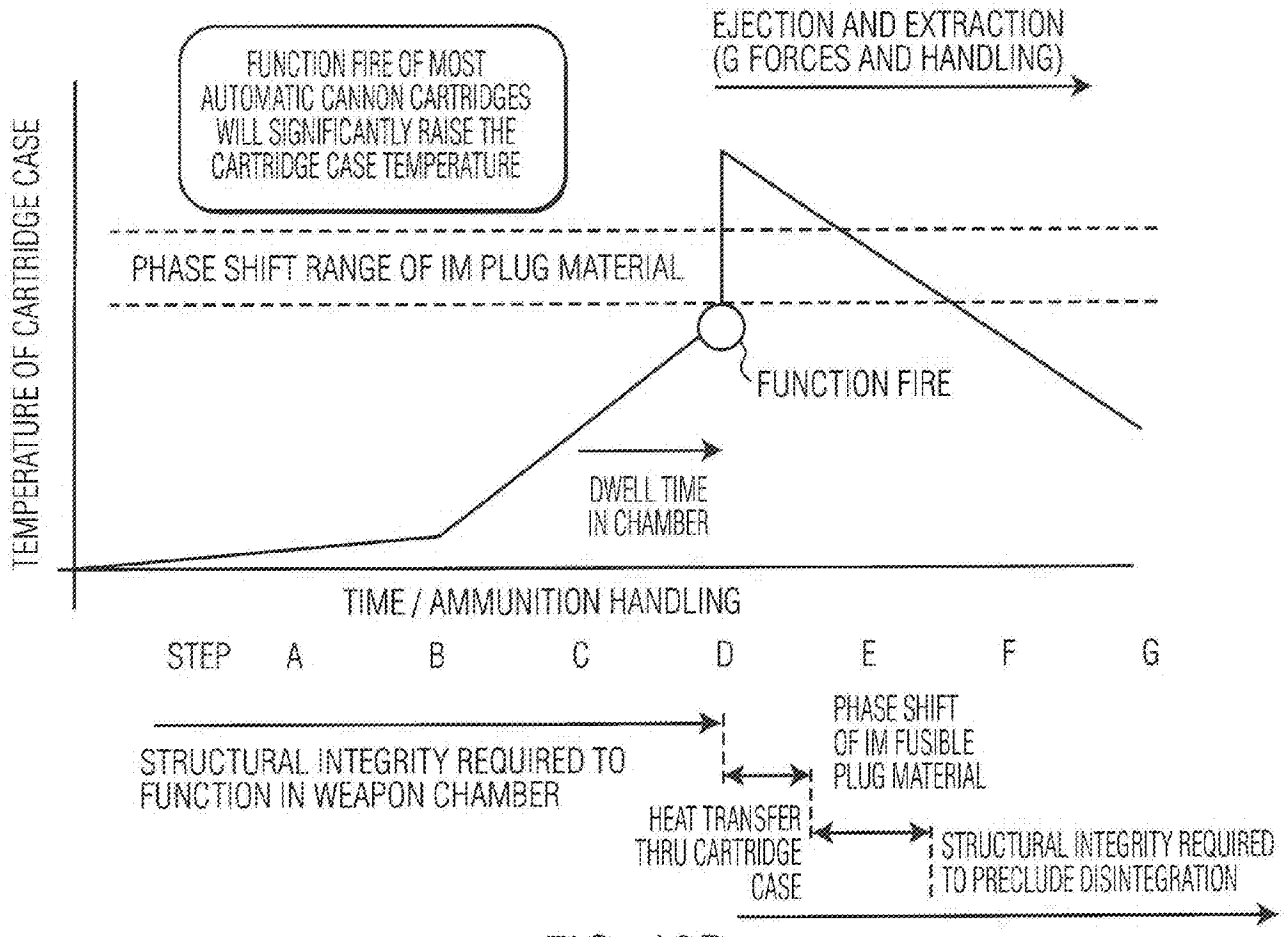
Figure 13C:
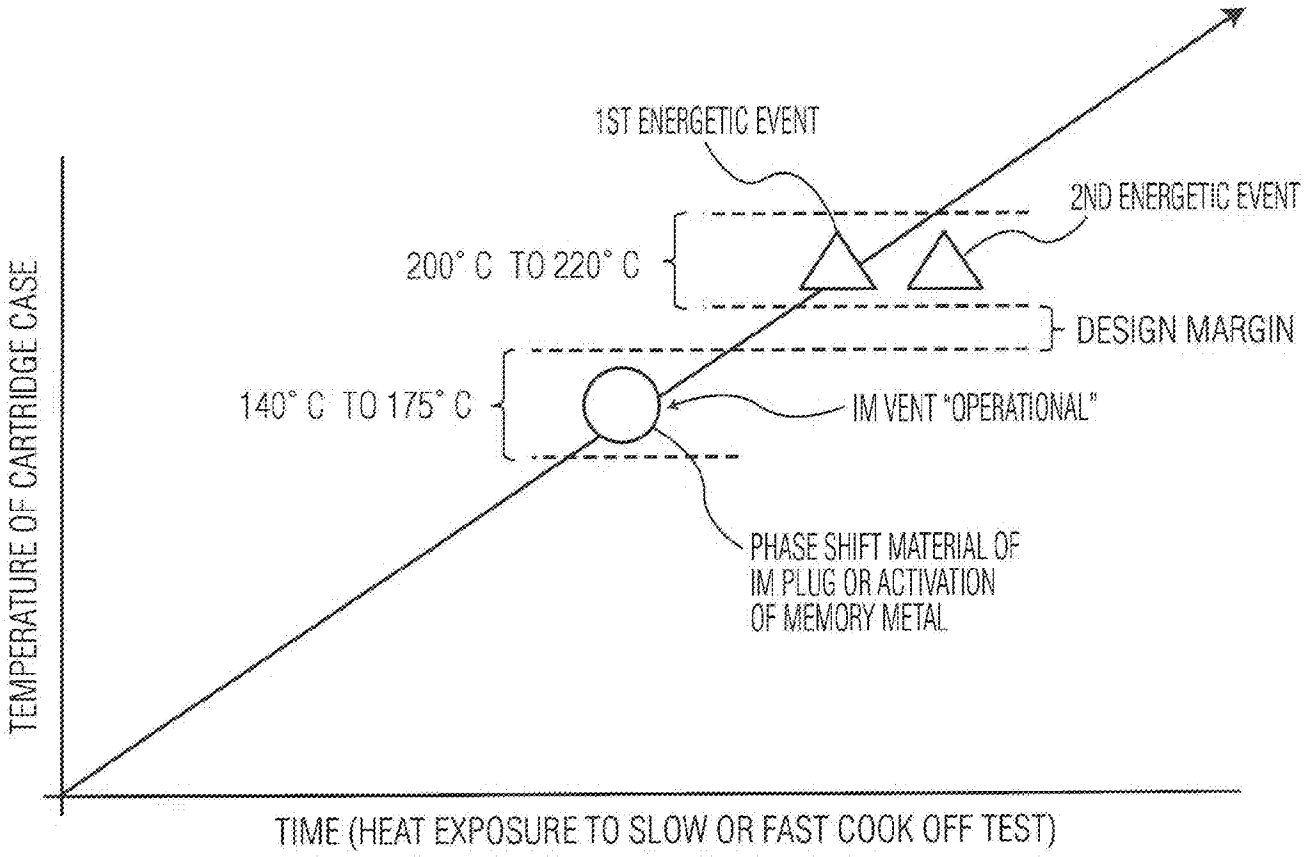

FIGS. 13A, 13B are time charts showing the cartridge case temperature during the seven automatic weapon firing steps A through G, as set forth and explained in the "Background of the Invention" section above. FIG. 13A shows the activation time of shape memory alloy while FIG. 13B shows the activation time of IM fusible plug material; that is, in both cases when the IM vent becomes operational. FIG. 13C is a time chart showing the IM vent activity upon heat exposure during a cook-off test, either a slow or fast cook-off.

As may be seen in FIGS. 13A and 13B, heat is rapidly transferred from the weapon to the cartridge case, but the munition is fired before the IM vent has time to activate.

Figure 5A:
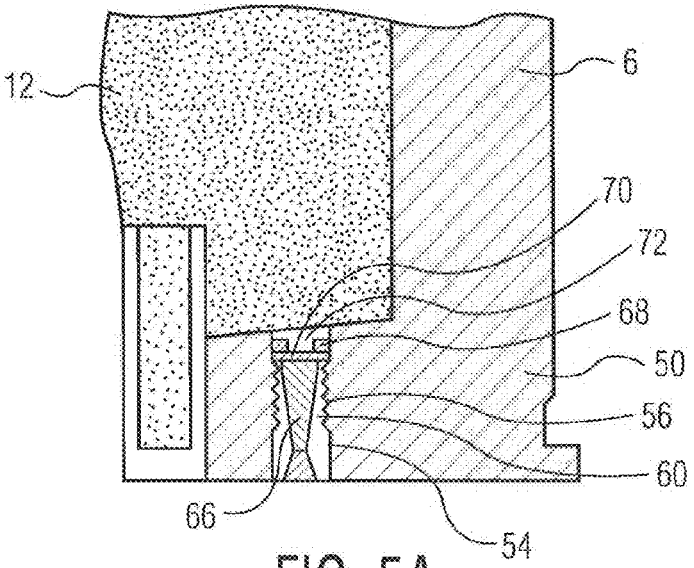
FIG. 5A is an enlarged representation showing detail thereof.
Figure 14:
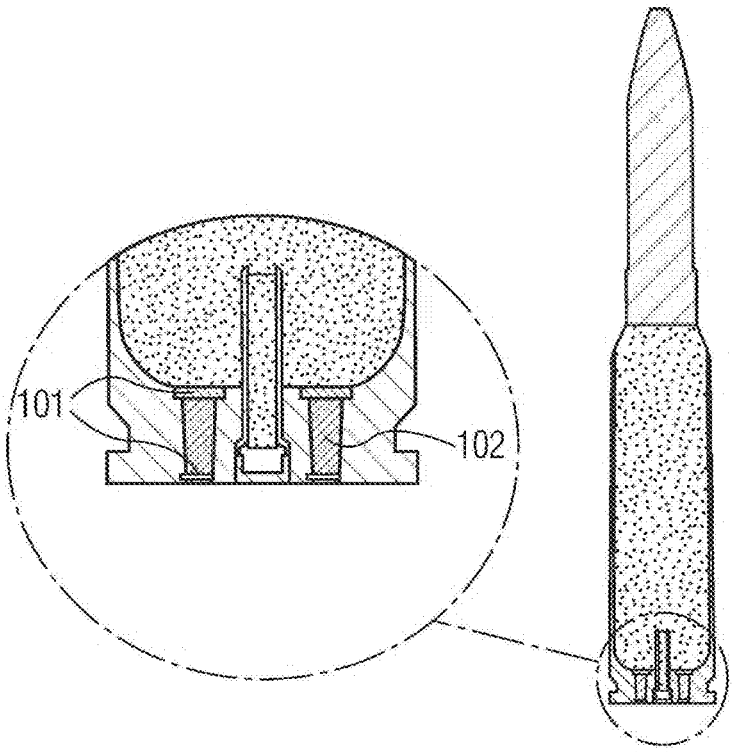
FIG. 14 is a cross-sectional view of a seventh preferred embodiment of an IM vent according to the invention.

FIG. 14 is a diagram of another embodiment of the present invention, similar to that of FIGS. 5 and 5A. In this embodiment the cartridge case is provided with two rupturable metal disks 101, one at each opposite end of the fusible material 102 in each venting channel. This arrangement provides additional structural strength and support to the cartridge case and prevents leakage of the fusible material at elevated temperatures.

Figure 15A:
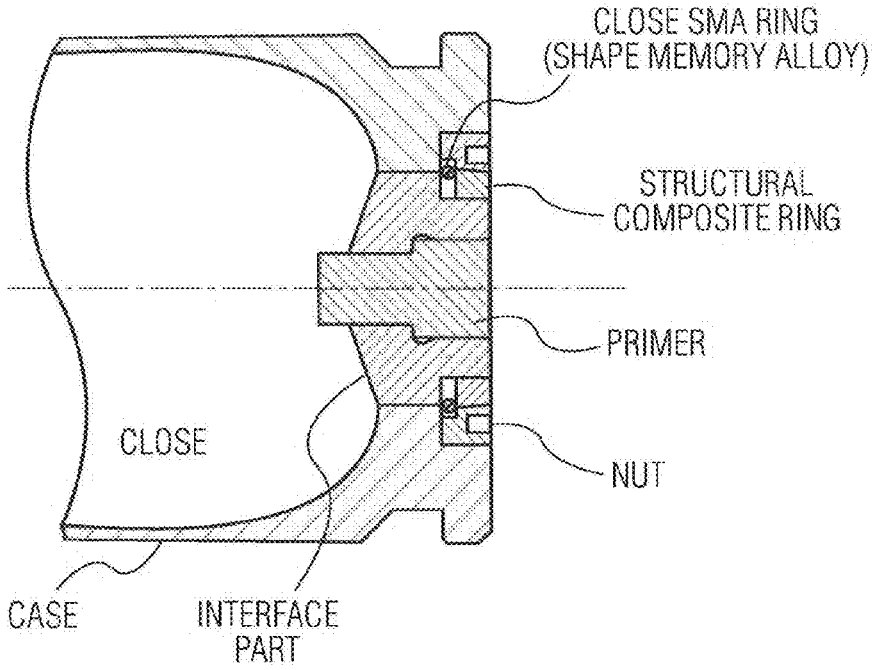
FIGS. 15A and 15B are cross-sectional views of an eighth preferred embodiment of an IM vent according to the invention, both before (15A) and during (15B) venting.
Figure 15B:
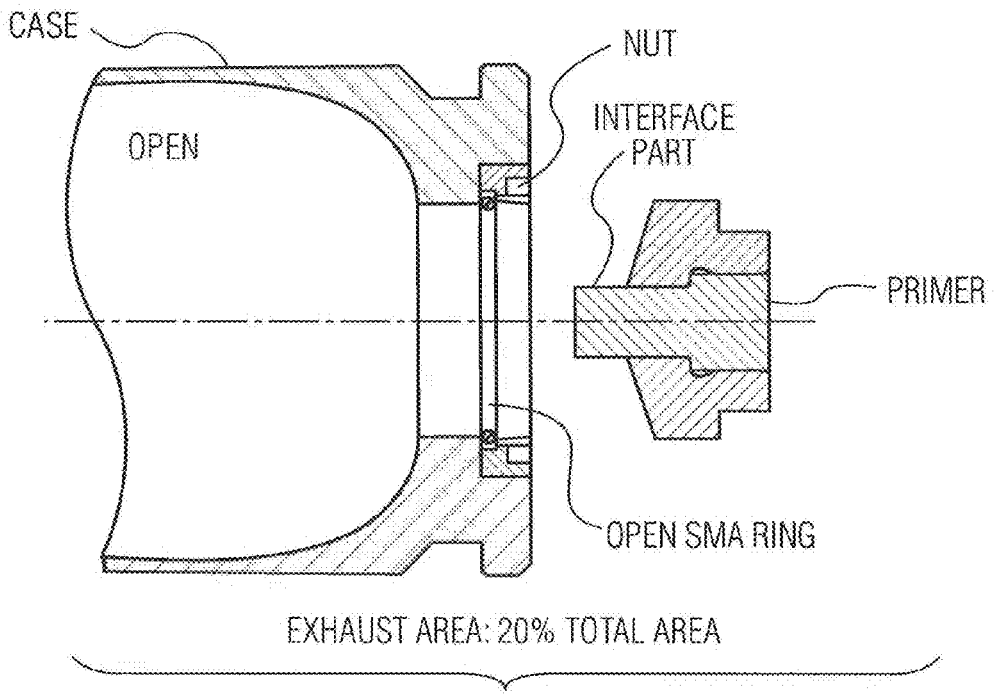

FIGS. 15A and 15B show still another embodiment of a PRS in a cartridge case. FIG. 15A a ring of shape memory alloy surrounds and retains a primer at the base of the cartridge. When heated to an elevated temperature (approximately 140° C.), the ring expands, releasing the primer, as shown in FIG. 15B.

Figure 16:
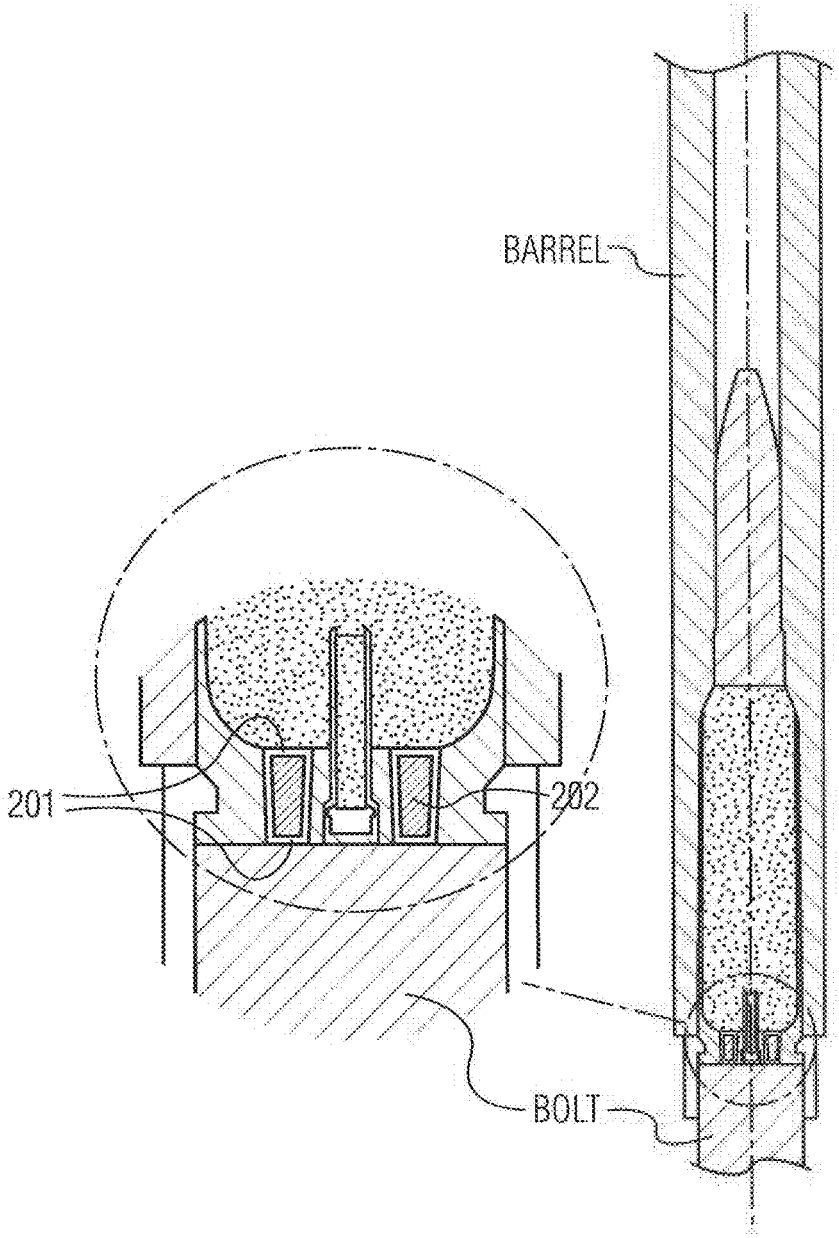
FIG. 16 is a cross-sectional view of a ninth preferred embodiment of an IM vent according to the invention.

FIG. 16 is a diagram of still another embodiment of the present invention, similar to that of FIGS. 5, 5A and 14. In this embodiment the fusible metal or polymer 202 in each venting channel is surrounded by non-fusible material 201. This arrangement also provides additional structural integrity to the IM bursting plug and prevents leakage of the fusible material at elevated temperatures.

Figure 17:
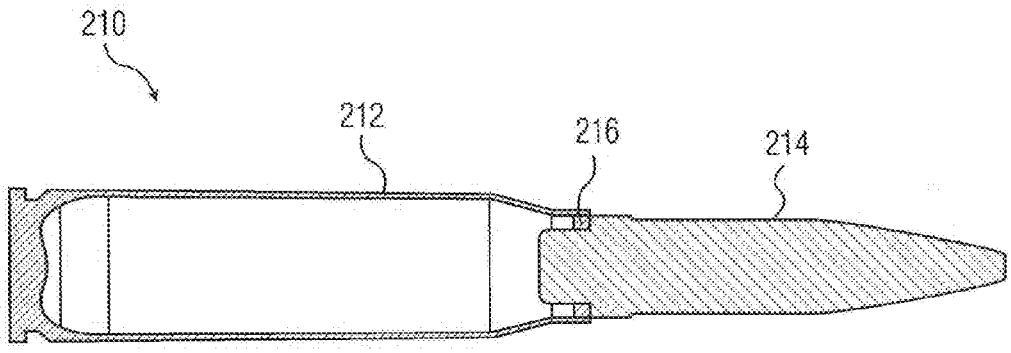
FIG. 17 is a cross-sectional view of a tenth preferred embodiment of an IM vent according to the invention.

FIG. 17 shows still another embodiment of a munition 210 with a cartridge case 212 crimped to a projectile 214. A memory metal ring 216, disposed between the cartridge case 212 and the projectile 214, expands on heating, separating and dislodging the projectile from the cartridge case and thus preventing undesired or accidental discharge of the projectile at elevated temperatures. When the munition is chambered in a barrel the ring 216 is unable to expand and the cartridge is prevented from separating except by firing through the barrel.

The PRS family described hereinabove provides an important contribution to IM compliant type V response in IM munitions development.

There has thus been shown and described a novel cartridge munition which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A cartridge munition comprising, in combination:

(a) a cartridge case having a base and an upper portion forming a propulsion chamber;

(b) a projectile having a base inserted into the upper portion of the cartridge case and mechanically connected thereto;

(c) a pyrotechnic propellant charge disposed in the propulsion chamber of the cartridge case whose propulsive gases exert a force on the base of the projectile when they burn causing the projectile to be driven out of the cartridge case; and (d) a pyrotechnic igniter or primer disposed in the base of the cartridge case for igniting the propellant charge;

the improvement wherein said cartridge munition includes a pressure release device for venting propulsive gases from the propulsion chamber of the cartridge case if an elevated ambient temperature, lower than the ignition temperature of the igniter and the propulsive charge, presents a risk of self-ignition, said pressure release device including a retaining ring made of shape-memory material, which surrounds the igniter and retains the igniter in the base of the cartridge case, and at least one ring-shaped nut adapted to fix said retaining ring in said base of the cartridge case;

wherein said retaining ring increases its diameter upon reaching said elevated temperature, thereby enabling separation of the igniter from the base of the cartridge case leaving an opening in the base of the cartridge for ventilation of propulsive gases.

2. The cartridge munition of claim 1, wherein heat flow is directed around the pressure release device by a metal shield having low heat transmission properties, thereby to provide for delayed separation of the igniter while the munition is retained in a hot barrel.

3. The cartridge munition of claim 2, wherein the metal shield is made at least in part of zirconium.

4. The cartridge munition of claim 1, wherein said pressure release device further comprises an igniter or primer support surrounding and holding the primer or igniter, and wherein said retaining ring surrounds and retains the igniter support in the base of said cartridge case and releases said igniter support upon reaching said elevated temperature.

5. The cartridge munition of claim 1, wherein said retaining ring is supported, at least in part, in the base of the cartridge case by a fusible, solid material whose melting temperature is lower than the ignition temperature of the igniter and the propulsive charge.

6. The cartridge munition of claim 1, wherein said at least one ring-shaped nut has engaged external threads or interlocking sleeved configuration in the base of the cartridge case.

7. The cartridge munition of claim 5, wherein the fusible solid material is at least one of fusible metal and a polymer.

8. The cartridge munition of claim 5, wherein the fusible solid material is a fusible metal consisting of an alloy of at least bismuth and tin and bismuth and lead.

9. The cartridge munition of claim 8, wherein the fusible metal is a bismuth/tin alloy with from about 30 to about 40% by weight of bismuth and from about 60 to about 70% by weight of tin, having a melting point of about 140° C.

10. The cartridge munition of claim 5, wherein the fusible solid material is a polymer which has a melting point of about 140° C.

* * * * *